US011002151B2

(12) United States Patent
Tsukiyama et al.

(10) Patent No.: US 11,002,151 B2
(45) Date of Patent: May 11, 2021

(54) TURBOCHARGER

(71) Applicant: TOYOTA JIDOSHA KABUSHIKI KAISHA, Toyota (JP)

(72) Inventors: Takashi Tsukiyama, Toyota (JP); Takeshi Murase, Iwakura (JP); Hiroaki Ikegami, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 27 days.

(21) Appl. No.: 16/692,113

(22) Filed: Nov. 22, 2019

(65) Prior Publication Data

US 2020/0173305 A1 Jun. 4, 2020

(30) Foreign Application Priority Data

Nov. 29, 2018 (JP) ..... JP2018-223249

(51) Int. Cl.
*F01D 25/24* (2006.01)
*F01D 25/08* (2006.01)
*F01D 25/16* (2006.01)

(52) U.S. Cl.
CPC ..... *F01D 25/08* (2013.01); *F01D 25/162* (2013.01); *F01D 25/24* (2013.01)

(58) Field of Classification Search
CPC ..... F01D 25/08; F01D 25/162; F01D 25/24; F01D 25/243; F05D 2220/40; F05D 2240/15; F05D 2260/39
See application file for complete search history.

(56) References Cited

U.S. PATENT DOCUMENTS 5,549,449 A * 8/1996 McInerney ..... F01D 25/14 384/413
6,032,466 A 3/2000 Woollenweber et al.
6,449,950 B1 9/2002 Allen et al.
6,739,845 B2 * 5/2004 Woollenweber ..... F04D 25/024 417/407
7,631,497 B2 * 12/2009 Panek ..... F01D 25/186 60/605.1
8,568,092 B2 * 10/2013 Matsuyama ..... F02B 39/00 415/173.3
2010/0187460 A1 7/2010 An et al.
2010/0296925 A1 * 11/2010 Sakai ..... F01D 25/243 415/214.1
2011/0014036 A1 * 1/2011 Boening ..... F16F 1/324 415/177

(Continued)

FOREIGN PATENT DOCUMENTS

DE 10 2013 111 561 A1 4/2015
EP 2233719 A1 9/2010

(Continued)

*Primary Examiner* — Igor Kershteyn
(74) *Attorney, Agent, or Firm* — Oliff PLC

(57) ABSTRACT

A V-clamp fastens a clamping flange of a turbine housing and a clamping flange of a bearing housing in a rotation axis direction of a connecting shaft so that the clamping flanges are fixed to each other. An annular heat shield plate is disposed between the turbine housing and the bearing housing. The heat shield plate is clamped by the turbine housing and the bearing housing. A clearance is disposed in an entire area between an opposed surface of the clamping flange of the turbine housing and an opposed surface of the clamping flange of the bearing housing.

3 Claims, 13 Drawing Sheets

(56) References Cited

U.S. PATENT DOCUMENTS

| | | | | |
|---|---|---|---|---|
| 2011/0085902 | A1 | 4/2011 | Yin et al. | |
| 2013/0170975 | A1* | 7/2013 | Ishii | F01D 9/045 415/208.1 |
| 2015/0037146 | A1* | 2/2015 | Yamaguchi | F02C 6/12 415/174.5 |
| 2015/0063989 | A1 | 3/2015 | Wang et al. | |
| 2016/0201693 | A1 | 7/2016 | An et al. | |

FOREIGN PATENT DOCUMENTS

| | | | |
|---|---|---|---|
| EP | 2818664 | A1 | 12/2014 |
| GB | 593031 | A | 10/1947 |
| JP | 2004-512453 | A | 4/2004 |
| JP | 2009-068380 | A | 4/2009 |
| JP | 2009-092026 | A | 4/2009 |
| JP | 2015-127517 | A | 7/2015 |
| JP | 2016-118105 | A | 6/2016 |
| JP | 2017-078435 | A | 4/2017 |
| JP | 2018-040317 | A | 3/2018 |
| JP | 2018-087556 | A | 6/2018 |
| WO | 2015001644 | A1 | 1/2015 |
| WO | 2016149727 | A1 | 9/2016 |

* cited by examiner

TURBOCHARGER

BACKGROUND

1. Field

The present disclosure relates to a turbocharger.

2. Description of Related Art

Japanese Laid-Open Patent Publication No. 2018-040317 discloses a turbocharger that includes a turbine wheel and a turbine housing accommodating the turbine wheel. The turbine wheel is fixed to one end of a connecting shaft. The connecting shaft is rotationally supported in a bearing housing. A flange is provided at an end of the turbine housing. Also, a flange is provided at an end of the bearing housing. The flanges of the turbine housing and the bearing housing are fixed to each other by a clamp member while being caused to abut against each other.

Since the turbocharger disclosed in Japanese Laid-Open Patent Publication No. 2018-040317 introduces exhaust gas into the turbine housing, the temperature of the turbine housing is high. Since heat is transferred to the bearing housing from the portion of the turbine housing that contacts the bearing housing, the temperature of that portion is likely to decrease. In contrast, since heat is not easily transferred to the bearing housing from the portion of the turbine housing that is far from the bearing housing, the temperature of that portion is unlikely to decrease. Accordingly, the turbine housing has portions of high temperatures and portions of low temperatures. When there are temperature differences in the turbine housing, the differences in the amounts of thermal expansion are likely to generate a great internal stress in the turbine housing. This can cause deformation and cracking of the turbine housing and is thus not favorable.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, a turbocharger is provided that includes a turbine housing that accommodates a turbine wheel and a bearing housing that rotationally supports a connecting shaft connected to the turbine wheel. A flange extends outward in a radial direction of the connecting shaft from an end of the turbine housing on a first side in a rotation axis direction of the connecting shaft. A flange extends outward in the radial direction of the connecting shaft from an end of the bearing housing on a second side in the rotation axis direction of the connecting shaft. The flange of the turbine housing and the flange of the bearing housing are fastened and fixed to each other by a fixing member in the rotation axis direction of the connecting shaft. An annular heat shield plate is disposed between the turbine housing and the bearing housing. The heat shield plate is clamped by the turbine housing and the bearing housing. The flange of the turbine housing includes an opposed surface that is opposed to the flange of the bearing housing in the rotation axis direction of the connecting shaft. The flange of the bearing housing includes an opposed surface that is opposed to the flange of the turbine housing in the rotation axis direction of the connecting shaft. A clearance is disposed in an entire area between the opposed surface of the turbine housing and the opposed surface of the bearing housing.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An embodiment will now be described with reference to FIGS. 1 to 15B.

<Passage Configuration of Intake and Exhaust>

First, the passage construction of intake and exhaust of an internal combustion engine 10 of a vehicle will be described.

Figure 1:
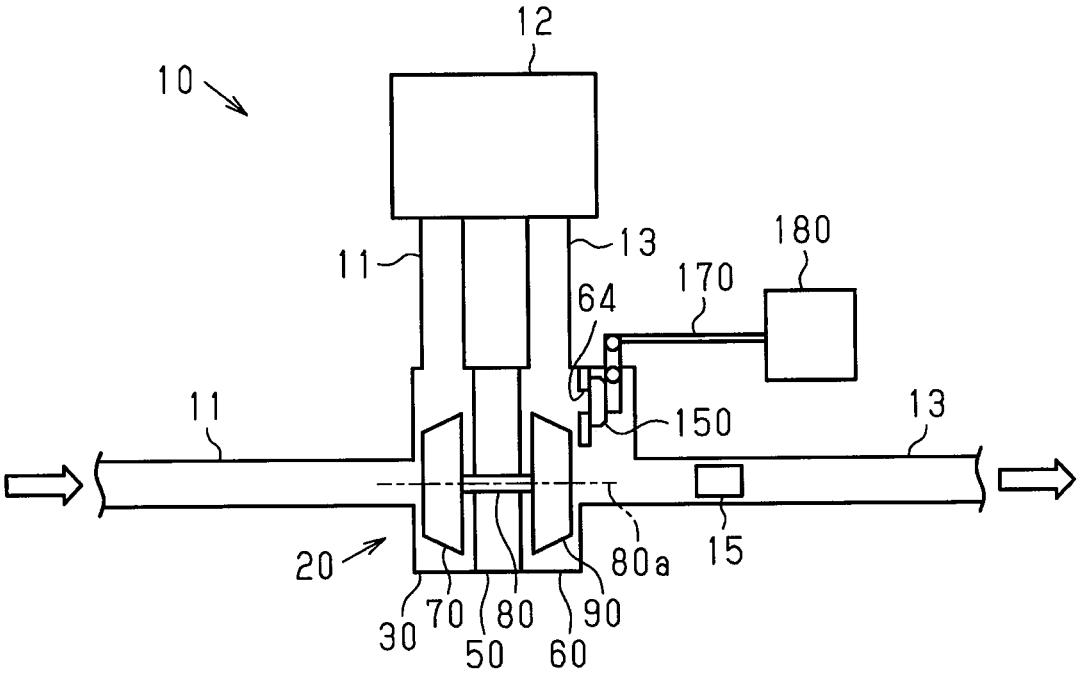
FIG. 1 is a schematic diagram of an internal combustion engine.

As shown in FIG. 1, the internal combustion engine 10 has an intake line 11, through Which intake air from the outside flows. The downstream end of the intake line 11 is connected to an engine body 12, in which a cylinder is defined, Fuel and intake air are mixed and the mixture is burned in the cylinder of the engine body 12. The engine body 12 is connected to the upstream end of an exhaust line 13, through which exhaust gas discharged from the engine body 12 flows. A catalyst 15, which purifies exhaust gas, is attached to the middle of the exhaust line 13.

The internal combustion engine 10 has a turbocharger 20 configured to compress intake air using the flow of exhaust gas. The turbocharger 20 has a compressor housing 30, which is installed in the middle of the intake line 11. The turbocharger 20 also has a turbine housing 60, which is attached to a section of the exhaust line 13 that is on the upstream side of the catalyst 15. The turbocharger 20 includes a bearing housing 50, which connects the compressor housing 30 and the turbine housing 60 to each other.

The compressor housing 30 accommodates a compressor wheel 70, which compresses intake air. The compressor wheel 70 is connected to a first end of a connecting shaft 80. The central portion of the connecting shaft 80 is accommodated in the bearing housing 50. The connecting shaft 80 is rotationally supported by the bearing housing 50. A second end of the connecting shaft 80 is connected to a turbine wheel 90, which is rotated by the flow of exhaust gas. The turbine wheel 90 is accommodated in the turbine housing 60. Rotation of the turbine wheel 90 by the flow of exhaust gas causes the compressor wheel 70, which is connected to the turbine wheel 90 via the connecting shaft 80, to rotate. The rotation of the compressor wheel 70 compresses intake air.

<Overall Configuration of Turbocharger>

The overall configuration of the turbocharger 20 will now be described. In the following description, the vertical direction of the vehicle on which the internal combustion engine 10 is mounted is defined as the vertical direction of the turbocharger 20. The direction along a rotation axis 80*a* of the connecting shaft 80 will be simply referred to as a rotation axis direction. A first side in the rotation axis direction (the side on which the compressor wheel 70 is located) will be referred to as an intake side. A second side in the rotation axis direction (the side on which the turbine wheel 90 is located) will be referred to as an exhaust side.

Figure 2:
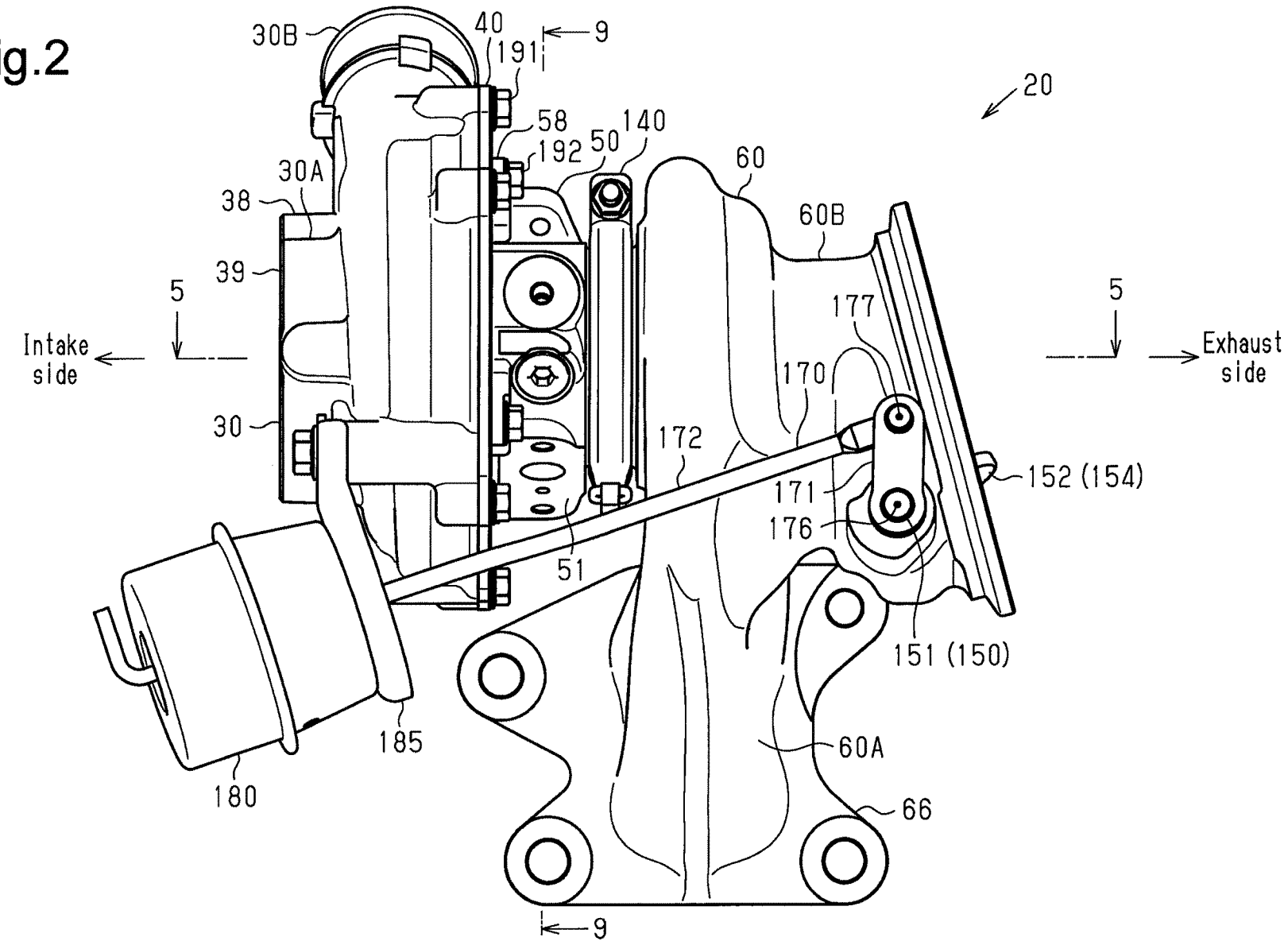
FIG. 2 is a front view of a turbocharger.
Figure 3:
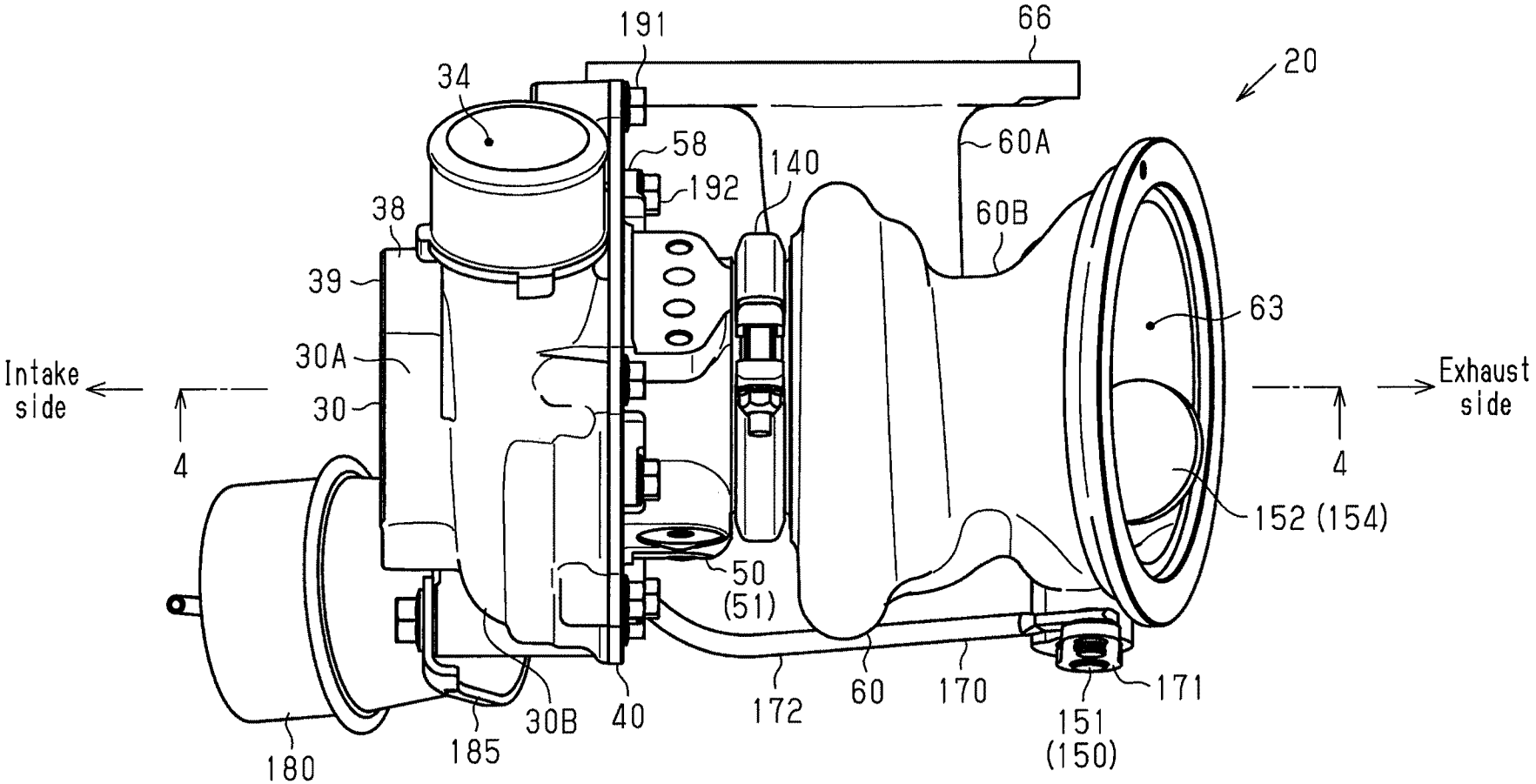
FIG. 3 is a plan view of the turbocharger.

As shown in FIGS. 2 and 3, the compressor housing 30 includes a housing body 39. The housing body 39 has tubular portion 30A, which is substantially cylindrical and extends in the rotation axis direction, and an arcuate portion 30B, which is substantially arcuate and extends to surround the tubular portion 30A. The arcuate portion 30B surrounds the end on the exhaust side (the right end) of the tubular portion 30A.

Figure 4:
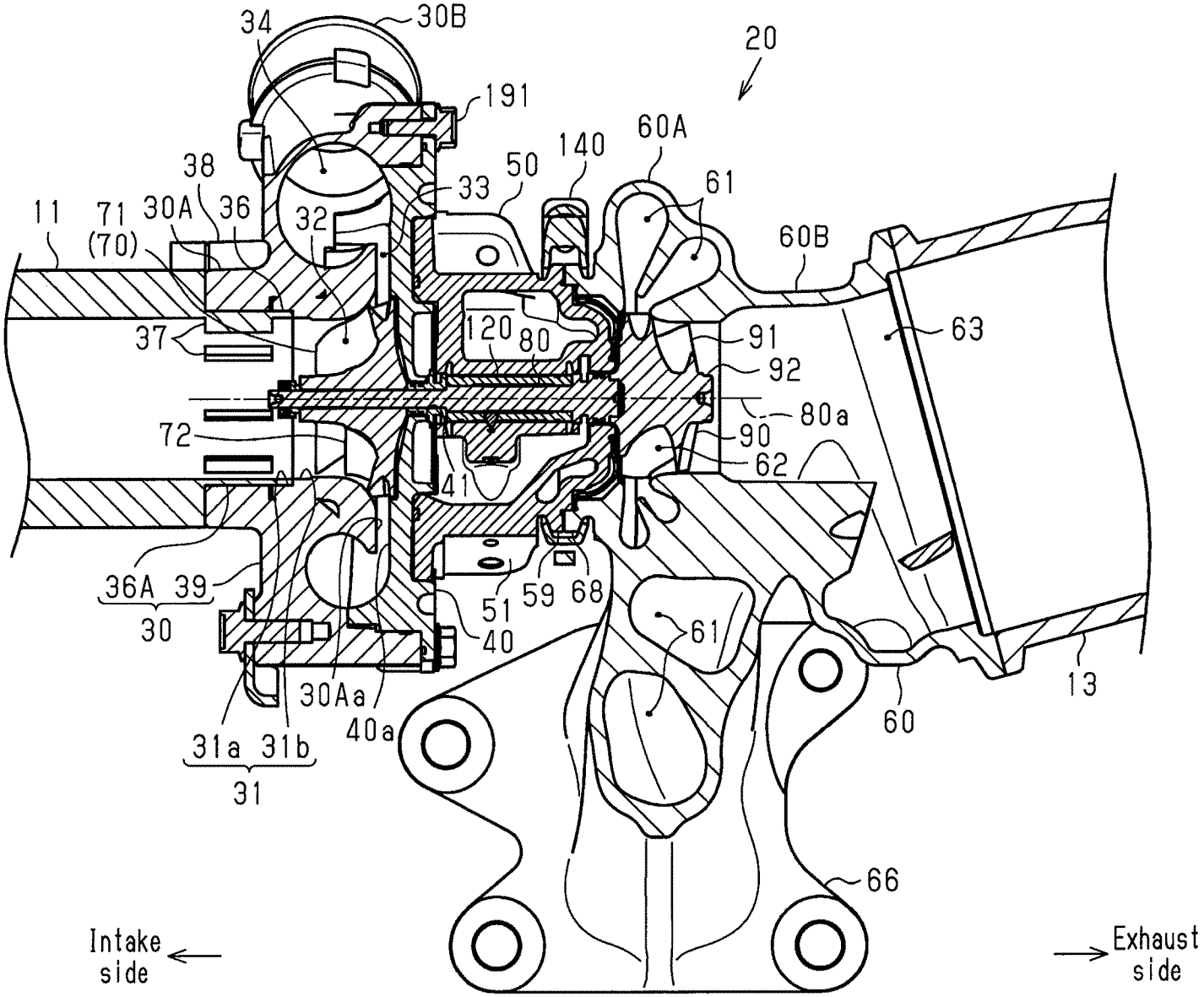
FIG. 4 is a cross-sectional view taken along line 4-4 of FIG. 3.

As shown in FIG. 4, the interior space of the tubular portion 30A of the housing body 39 includes a section on the exhaust side that serves as an accommodation space 32 configured to accommodate the compressor wheel 70. The central axis of the accommodation space 32 is coaxial with the rotation axis 80*a* of the connecting shaft 80.

An insertion hole 31 extends toward the intake side from the end on the intake side of the accommodation space 32. The insertion hole 31 opens in the outer surface of the housing body 39. The central axis of the insertion hole 31 is coaxial with the rotation axis 80*a* of the connecting shaft 80.

A boss 38 protrudes from the outer circumferential surface of the tubular portion 30A of the housing body 39. The boss 38 has a substantially cylindrical shape extending in the rotation axis direction, A section of the intake line 11 that is on the upstream side of the compressor housing 30 is connected to the boss 38 with bolts (not shown).

A seal plate 40, which has a disk shape as a whole, is arranged in the exhaust side of the housing body 39. The outer diameter of the seal plate 40 is substantially the same as the outer diameter of the arcuate portion 30B of the housing body 39. The radially outer portion of the seal plate 40 is fixed to the end on the exhaust side of the arcuate portion 30B of the housing body 39 with bolts 191. The seal plate 40 has an insertion hole 41 at the center in the radial direction. The insertion hole 41 extends in the rotation axis direction through the seal plate 40. The connecting shaft 80 is inserted through the insertion hole 41.

The arcuate portion 30B of the housing body 39 has a scroll passage 34 defined therein. The scroll passage 34 discharges intake air from the housing body 39. The scroll passage 34 extends in a circumferential direction about the rotation axis 80*a* of the connecting shaft 80 to surround the compressor wheel 70. A section of the intake line 11 that is on the downstream side of the compressor housing 30 is fixed to the end in the extending direction of the arcuate portion 30B of the housing body 39. The end on the exhaust side of the scroll passage 34 reaches the end on the exhaust side of the arcuate portion 30B. The portion on the exhaust side of the scroll passage 34 is closed by an end face 40*a* on the intake side of the seal plate 40. That is, the end face 40*a* of the seal plate 40 constitutes a part of the inner wall surface of the scroll passage 34. The portion on the exhaust side of the accommodation space 32 is closed by the end face 40*a* of the seal plate 40.

A clearance is provided between the intake-side end face 40*a* of the seal plate 40 and an exhaust-side end face 30Aa of the tubular portion 30A of the housing body 39. The clearance functions as a connection passage 33, which connects the accommodation space 32 of the tubular portion 30A to the scroll passage 34 of the arcuate portion 30B.

Figure 7:
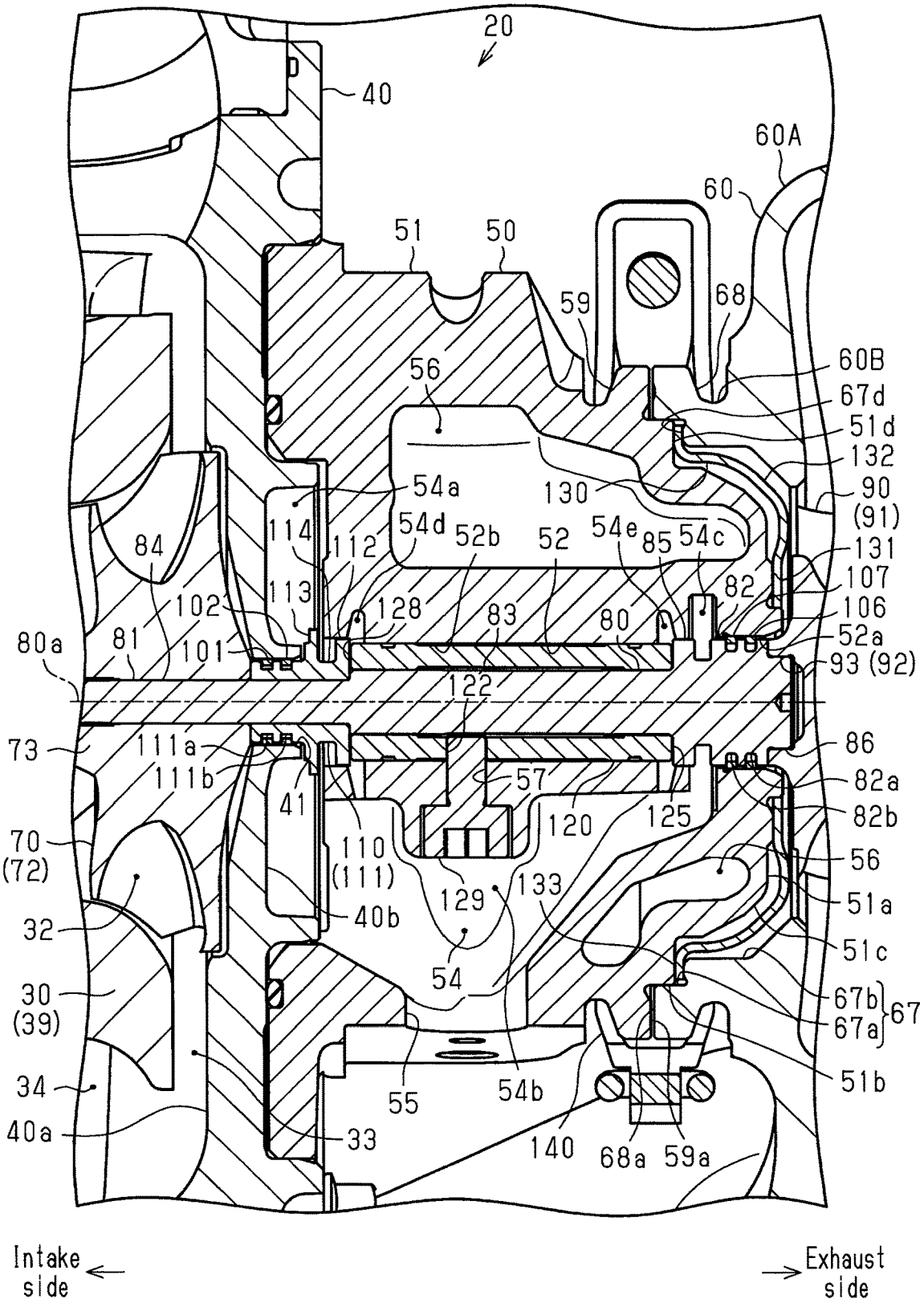
FIG. 7 is a partial cross-sectional view taken along line 6-6 of FIG. 9.

As shown in FIG. 7, a main body 51 of the bearing housing 50 is disposed on the exhaust side of the seal plate 40. The main body 51 has a columnar shape as a whole and extends from the seal plate 40 toward the exhaust side. The main body 51 has a support hole 52, which extends in the rotation axis direction through the radial center of the main body 51. The central axis of the support hole 52 is coaxial with the rotation axis 80*a* of the connecting shaft 80.

Figure 9:
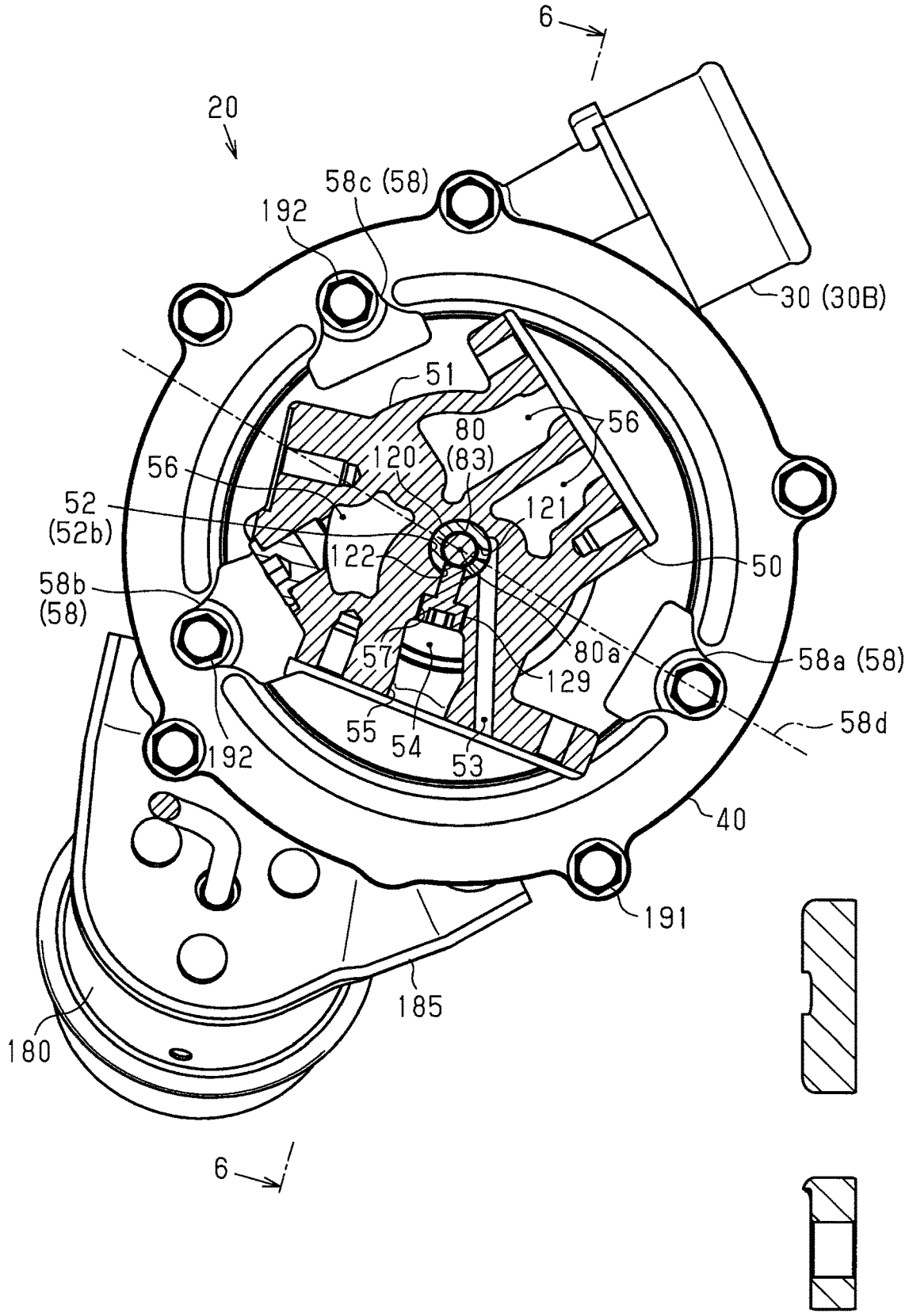
FIG. 9 is a cross-sectional view taken along line 9-9 of FIG. 2.

As shown in FIG. 9, the main body 51 has an oil introduction passage 53 defined therein. The oil introduction passage 53 is configured to supply oil from the outside of the bearing housing 50 to the inside of the main body 51. The oil introduction passage 53 has a first end connected to the support hole 52. The oil introduction passage 53 also has a second end that is open in the outer circumferential surface of the main body 51. The second end of the oil introduction passage 53 is located in a lower part of the outer circumferential surface of the main body 51. An oil supply line (not shown) is connected to the oil introduction passage 53. Oil is supplied to the oil introduction passage 53 through the oil supply line.

The main body 51 has an oil discharge space 54 defined therein. The oil discharge space 54 is configured to discharge oil to the outside from the inside of the main body 51. Most of the oil discharge space 54 is located below the support hole 52. As shown in FIG. 7, the oil discharge space 54 extends in the rotation axis direction. The end on the intake side of the oil discharge space 54 reaches the end on the intake side of the main body 51. The intake-side portion of the oil discharge space 54 is closed by an end face 40*b* on the exhaust side of the seal plate 40. That is, the end face 40*b* of the seal plate 40 constitutes a part of the inner wall surface of the oil discharge space 54. The depth of the oil discharge space 54 increases toward the center from either end of the main body 51 in the rotation axis direction.

As shown in FIG. 7, the main body 51 has an oil discharge port 55 defined therein. The oil discharge port 55 connects the oil discharge space 54 to the outside of the main body 51. The oil discharge port 55 has a first end connected to the lowest part of the oil discharge space 54. The oil discharge port 55 also has a second end that is open in the outer circumferential surface of the main body 51. The second end of the oil discharge port 55 is located in a lower part of the outer circumferential surface of the main body 51 and is adjacent to the second end (opening) of the oil introduction passage 53. An oil discharge line (not shown) is connected to the oil discharge port 55. Oil is discharged from the oil discharge port 55 through the oil discharge line.

The main body 51 has a coolant passage 56 defined therein. Coolant flows through the coolant passage 56. The coolant passage 56 extends in the rotation axis direction. Coolant that is pressure-fed by a water pump (not shown) flows through the coolant passage 56, and heat exchange between the coolant flowing through the coolant passage 56 and the bearing housing 50 cools the bearing housing 50.

A substantially cylindrical floating bearing 120 is inserted into the support hole 52. The dimension in the rotation axis direction of the floating bearing 120 is smaller than the dimension in the rotation axis direction of the main body 51. The floating bearing 120 is arranged at the center in the rotation axis direction of the main body 51. As shown in FIG. 9, the floating bearing 120 has a supply hole 121 extending therethrough in the radial direction. The supply hole 121 is continuous with the oil introduction passage 53.

Oil is supplied to the space between the outer circumferential surface of the floating bearing 120 and the inner circumferential surface of the support hole 52 via the oil introduction passage 53 of the bearing housing 50. Thus, the floating bearing 120 is supported by the main body 51 of the bearing housing 50 while floating in the oil supplied to the space between the outer circumferential surface of the floating bearing 120 and the inner circumferential surface of the support hole 52.

The connecting shaft 80 is inserted into the floating bearing 120. Oil is supplied to the space between the outer circumferential surface of the connecting shaft 80 and the inner circumferential surface of the floating bearing 120 via the supply hole 121. Thus, the connecting shaft 80 is rotationally supported with the oil supplied to the space between the outer circumferential surface of the connecting shaft 80 and the inner circumferential surface of the floating bearing 120.

As shown in FIG. 7, the bearing housing 50 includes a clamping flange 59, which protrudes from the outer circumferential surface of the main body 51. Specifically, the clamping flange 59 is located in a section of the outer circumferential surface that is on the exhaust side of the center in the rotation axis direction and protrudes outward in the radial direction of the connecting shaft 80. The clamping flange 59 extends over the entire area in the circumferential direction of the connecting shaft 80 and is substantially annular.

Figure 8:
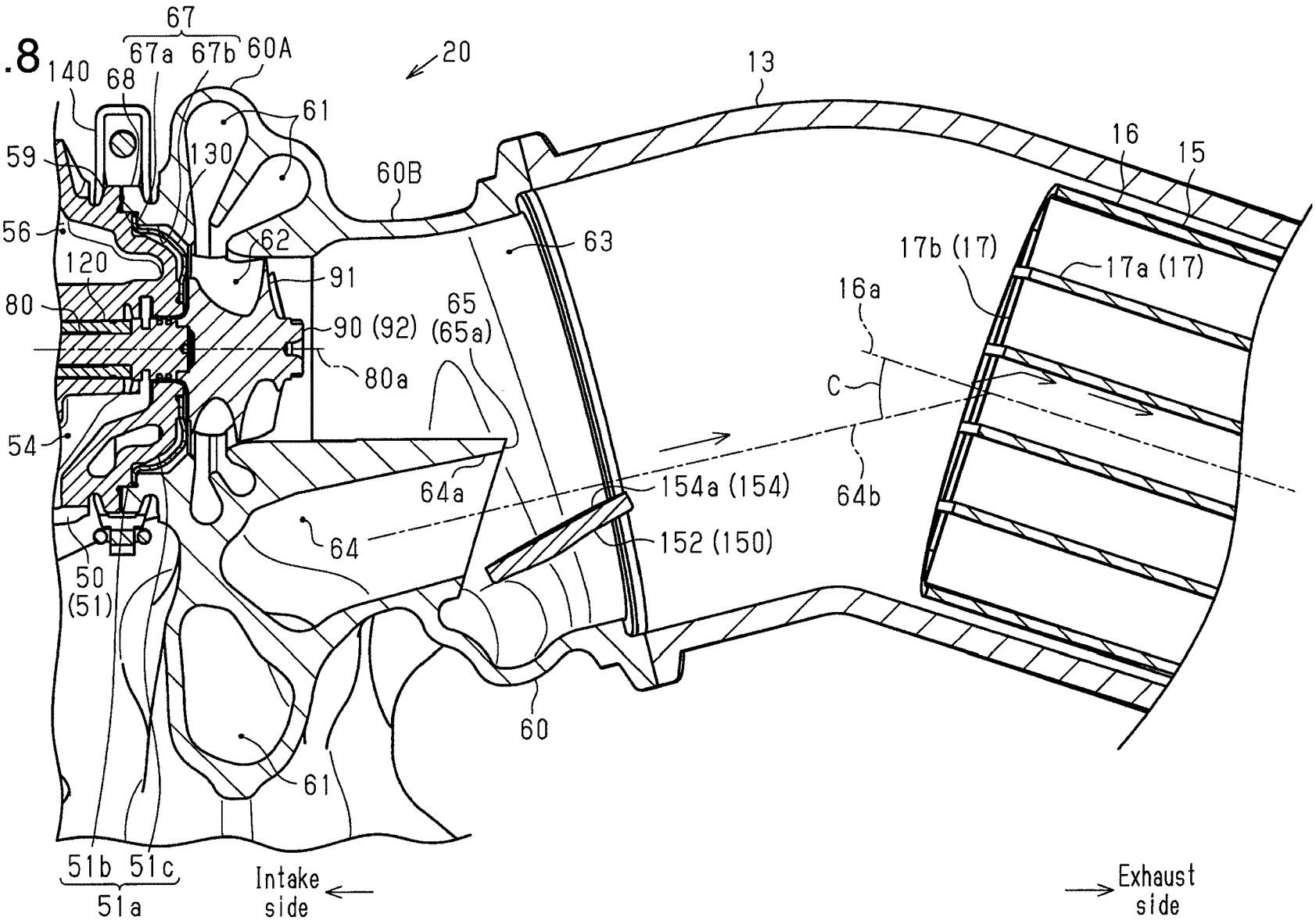
FIG. 8 is a partial cross-sectional view taken along line 6-6 of FIG. 9.

As shown in FIG. 8, the turbine housing 60 is arranged on the exhaust side of the bearing housing 50. The turbine housing 60 includes a tubular portion 60B and an arcuate portion 60A. The tubular portion 60B is substantially cylindrical and extends toward the exhaust side from the bearing housing 50. The arcuate portion 60A is substantially arcuate and extends to surround the outer circumference of the tubular portion 60B. The arcuate portion 60A surrounds a portion of the tubular portion 60B that is slightly on the intake side of the center in the rotation axis direction of the tubular portion 60B.

The turbine housing 60 includes a clamping flange 68, which protrudes from the outer circumferential surface of the tubular portion 60B. Specifically, the clamping flange 68 is located at the end of the outer circumferential surface that is on the intake side and protrudes outward in the radial direction of the connecting shaft 80. The clamping flange 68 extends over the entire area in the circumferential direction of the connecting shaft 80 and is substantially annular. The outer diameter of the clamping flange 68 of the turbine housing 60 is substantially the same as the outer diameter of the clamping flange 59 of the bearing housing 50.

A V-clamp 140, which is a fixing member, is attached to the radially outer sides of the clamping flange 68 of the turbine housing 60 and the clamping flange 59 of the bearing housing 50. The V-clamp 140 extends in the circumferential direction of the connecting shaft 80 and has an annular shape as a whole. The V-clamp 140 has a substantially V-shape in a cross section orthogonal to the extending direction of the V-clamp 140 and has an opening on the inner side in the radial direction of the connecting shaft 80. The clamping flange 68 of the turbine housing 60 and the clamping flange 59 of the bearing housing 50 are arranged radially inward of the V-clamp 140. The V-clamp 140 fastens the clamping flange 68 of the turbine housing 60 and the clamping flange 59 of the bearing housing 50 in the rotation axis direction so that the clamping flanges 68 and 59 are fixed to each other. A heat shield plate 130 is arranged between the tubular portion 60B of the turbine housing 60 and the main body 51 of the bearing housing 50. The heat shield plate 130 limits heat transfer from the exhaust gas flowing through the turbine housing 60 to the bearing housing 50.

The arcuate portion 60A has two scroll passages 61 defined therein. The scroll passages 61 are configured to draw in exhaust gas from the outside of the turbine housing 60. The scroll passages 61 extend in a circumferential direction about the rotation axis 80*a* of the connecting shaft 80 to surround the turbine wheel 90. As shown in FIG. 4, an upstream-side flange 66 protrudes from the turbine housing 60. Specifically, the upstream-side flange 66 extends from the end in the extending direction of the arcuate portion 60A and protrudes outward in the radial direction of the scroll passages 61. A section of the exhaust line 13 that is on the upstream side of the turbine housing 60 is connected to the upstream-side flange 66 with bolts (not shown). The scroll passages 61 are arranged side by side in the rotation axis direction.

The interior space of the tubular portion 60B includes a section on the intake side that serves as an accommodation space 62 configured to accommodate the turbine wheel 90. The central axis of the accommodation space 62 is coaxial with the rotation axis 80*a* of the connecting shaft 80.

A discharge passage 63 extends toward the exhaust side from the end on the exhaust side of the accommodation space 62. The end on the exhaust side of the discharge passage 63 reaches the end on the exhaust side of the tubular portion 60B and opens in the outer surface of the turbine housing 60. Thus, exhaust gas introduced into the accommodation space 62 is discharged to the outside of the turbine housing 60 via the discharge passage 63. A section of the exhaust line 13 that is on the downstream side of the turbine housing 60 is fixed to the end on the exhaust side of the tubular portion 60B of the turbine housing 60.

The turbine housing 60 has two bypass passages 64 defined in the arcuate portion 60A and the tubular portion 60B. The bypass passages 64 connect the scroll passages 61 and the discharge passage 63 to each other. That is, the bypass passages 64 bypass the turbine wheel 90. The bypass passages 64 extend substantially linearly from the scroll passages 61 toward the downstream end of the discharge passage 63. In the present embodiment, the two bypass passages 64 correspond to the two scroll passages 61.

Figure 13:
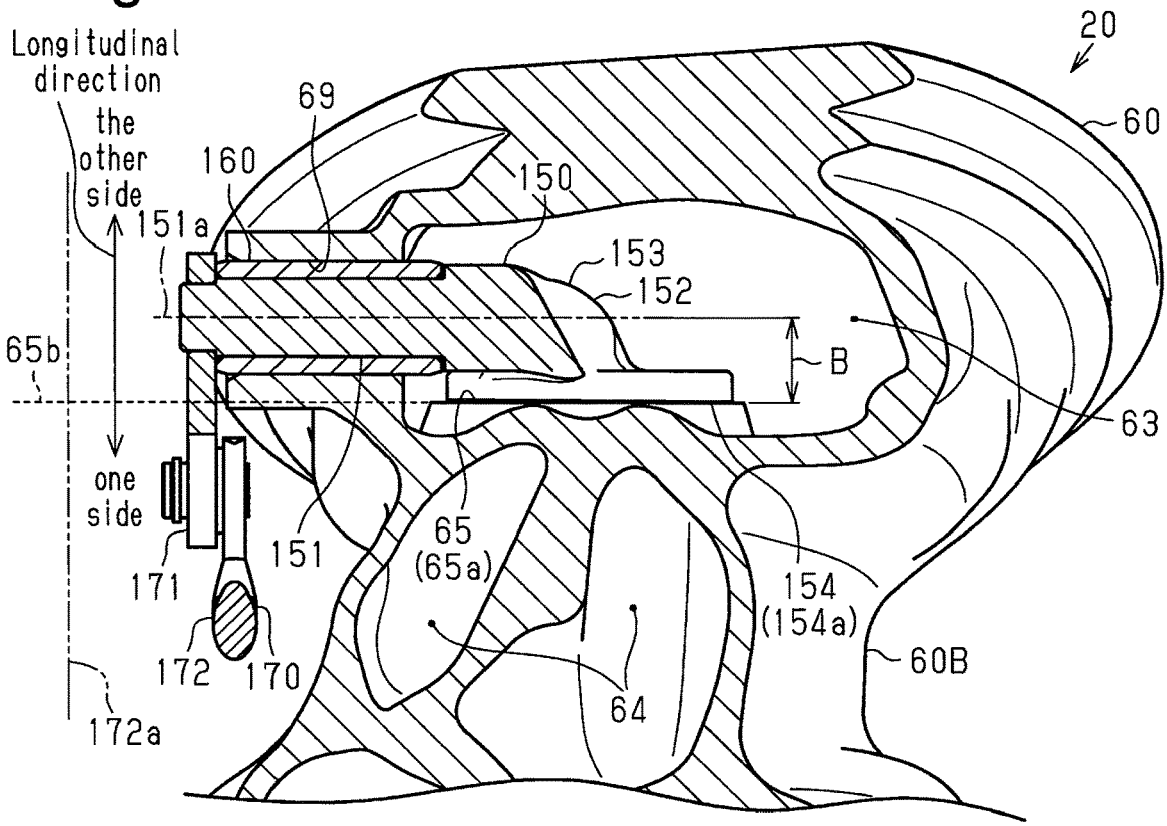
FIG. 13 is a partial cross-sectional view of a turbocharger.

As shown in FIG. 13, a wastegate 150, which is configured to selectively open and close the bypass passages 64, is attached to the turbine housing 60. The wastegate 150 includes a shaft 151, which extends through the wall of the tubular portion 60B of the turbine housing 60 and is rotationally supported by the turbine housing 60. A valve member 152 extends radially outward from the end of the shall 151 in the turbine housing 60. The valve member 152 is arranged in the discharge passage 63 of the turbine housing 60.

As shown in FIG. 2, the end of the shaft 151 outside the turbine housing 60 is coupled to a first end of a link mechanism 170, which transmits driving force. A second end of the link mechanism 170 is coupled to an actuator 180. The actuator 180 is fixed to the arcuate portion 30B of the housing body 39 of the compressor housing 30 via a fixing plate 185. When the driving force of the actuator 180 is transmitted to the wastegate 150 via the link mechanism 170, the wastegate 150 selectively opens and closes the bypass passages 64.

<Configuration of Components of Turbocharger 20>

The configuration of components of the turbocharger 20 will now be described. First, the bearing housing 50, the floating bearing 120, and the connecting shaft 80 will be described.

<Configuration of Bearing Housing 50 and Floating Bearing 120>

As shown in FIG. 7, the support hole 52 of the bearing housing 50 includes, as major parts, an exhaust-side support hole 52*a* on the exhaust side of the oil discharge space 54 and an intake-side support hole 52*b* on the intake side of the exhaust-side support hole 52*a*. The inner diameter of the intake-side support hole 52*b* is slightly greater than the outer diameter of the floating bearing 120. The dimension in the rotation axis direction of the intake-side support hole 52*b* is slightly greater than the dimension in the rotation axis direction of the floating bearing 120. The floating bearing 120 is inserted into the intake-side support hole 52*b* of the support hole 52. As shown in FIG. 9, the intake-side support hole 52*b* of the support hole 52 is connected to the first end of the oil introduction passage 53.

As shown in FIG. 7, the main body 51 of the bearing housing 50 has a through-hole 57 defined therein. The through-hole 57 extends downward from the intake-side support hole 52*b* of the support hole 52. The lower end of the through-hole 57 is connected to the oil discharge space 54. The oil discharge port 55 is located on an extension of the through-hole 57. The inner diameter of the lower portion of the through-hole 57 is greater than that of the upper portion, so that the through-hole 57 has a step at the boundary between the lower portion and the upper portion.

Figure 10A:
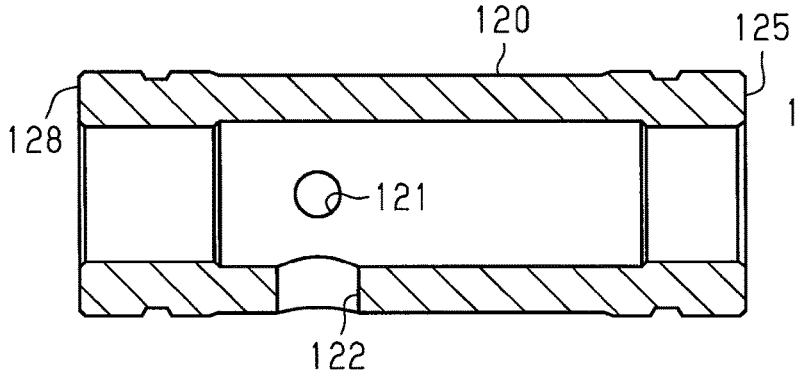
FIG. 10A is a cross-sectional view of a floating bearing.

As shown in FIG. 10A, the floating bearing 120 has a fixing hole 122 extending therethrough in the radial direction. The central axis of the fixing hole 122 is coaxial with the central axis of the through-hole 57. As shown in 7, a fixing pin 129 is inserted through the fixing hole 122 and the through-hole 57. This fixes the floating bearing 120 such that the floating bearing 120 cannot rotate relative to the main body 51 of the bearing housing 50 or move in the rotation axis direction. The fixing pin 129 is positioned in the axial direction by the step of the through-hole 57, and the upper end of the fixing pin 129 does not contact the outer circumferential surface of the connecting shaft 80.

Figure 11:
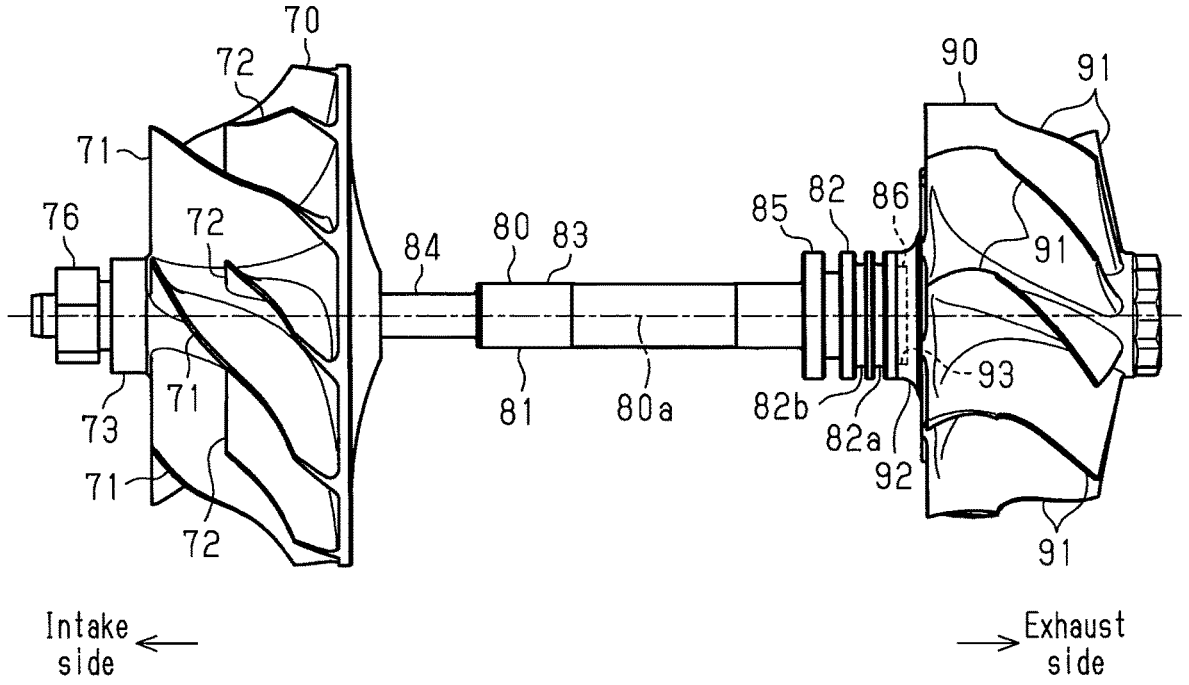
FIG. 11 is a front view of a compressor wheel, a connecting shaft, and a turbine wheel.

As shown in FIG. 11, the connecting shaft 80 has a shaft body 81 that extends in the rotation axis direction and has a substantially circular cross section as a whole. The shaft body 81 includes, as major parts, a large diameter portion 82, a middle diameter portion 83, which has an outer diameter smaller than that of the large diameter portion 82, and a small diameter portion 84, which has an outer diameter smaller than that of the middle diameter portion 83, arranged in order from the end on the exhaust side.

The outer diameter of the large diameter portion 82 is slightly smaller than the inner diameter of the exhaust-side support hole 52*a* of the support hole 52. The dimension in the rotation axis direction of the large diameter portion 82 is substantially the same as the dimension in the rotation axis direction of the exhaust-side support hole 52*a* of the bearing housing 50.

As shown in FIG. 11, a first recess 82*a* is provided in the outer circumferential surface of the large diameter portion 82. The first recess 82*a* is recessed inward in the radial direction of the connecting shaft 80. The first recess 82*a* extends annularly over the entire area in the circumferential direction of the connecting shaft 80. As shown in FIG. 7, a first sealing member 106 is attached to the first recess 82*a*. The first sealing member 106 limits entry of the exhaust gas from the turbine housing 60 into the bearing housing 50. The first sealing member 106 has a C-shape extending in the circumferential direction of the connecting shaft 80. In the present embodiment, the first sealing member 106 extends over approximately 359 degrees in the circumferential direction of the connecting shaft 80. In other words, the first sealing member 106 has a shape of a ring with a slit. The outer diameter of the first sealing member 106 is substantially the same as the inner diameter of the exhaust-side support hole 52*a* of the support hole 52 in the bearing housing 50.

As shown in FIG. 11, a second recess 82*b* is provided in the outer circumferential surface of the large diameter portion 82. The second recess 82*b* is located on the intake side of the first recess 82*a* and is recessed inward in the radial direction of the connecting shaft 80. The second recess 82*b* extends annularly over the entire area in the circumferential direction of the connecting shaft 80. As shown in FIG. 7, a second sealing member 107 is attached to the second recess 82*b*. The second sealing member 107 limits entry of exhaust gas from the turbine housing 60 into the bearing housing 50. The second sealing member 107 has a C-shape extending in the circumferential direction of the connecting shaft 80. In the present embodiment, the second sealing member 107 extends over approximately 359 degrees in the circumferential direction of the connecting shaft 80. In other words, the second sealing member 107 has a shape of a ring with a slit. The outer diameter of the second sealing member 107 is substantially the same as the inner diameter of the exhaust-side support hole 52*a* in the support hole 52 of the bearing housing 50.

As shown in FIG. 7, the large diameter portion 82 of the connecting shaft 80 is inserted into the exhaust-side support hole 52*a* of the support hole 52. Thus, the first sealing member 106 is disposed between the outer circumferential surface of the large diameter portion 82 of the connecting shaft 80 and the inner circumferential surface of the exhaust-side support hole 52*a* of the support hole 52. Also, the second sealing member 107 is disposed between the outer circumferential surface of the large diameter portion 82 of the connecting shaft 80 and the inner circumferential surface of the exhaust-side support hole 52*a* of the support hole 52, The second sealing member 107 is located on the intake side of the first sealing member 106.

When viewed in the rotation axis direction, the second sealing member 107 is installed such that its slit in the C-shape is separated from the slit of the C-shape of the first sealing member 106 by 180 degrees. Thus, when viewed in the rotation axis direction, at least one of the first sealing member 106 and the second sealing member 107 exists at any position in the entire area in the circumferential direction of the connecting shaft 80.

As described above, the coolant passage 56 is defined in the bearing housing 50. Heat exchange between the coolant flowing through the coolant passage 56 and the bearing housing 50 cools the bearing housing 50. The end on the exhaust side of the coolant passage 56 reaches the vicinity of the first sealing member 106 and the second sealing member 107. Specifically, the end on the exhaust side of the coolant passage 56 reaches a position on the exhaust side of the second sealing member 107. Also, the end on the exhaust side of the coolant passage 56 is defined to surround the first sealing member 106 and the second sealing Member 107 from the radially outer side.

The outer diameter of the middle diameter portion 83 of the connecting shaft 80 is slightly smaller than the inner diameter of the floating bearing 120. The dimension in the rotation axis direction of the middle diameter portion 83 is slightly greater than the dimension in the rotation axis direction of the floating bearing 120. The middle diameter portion 83 is inserted into the floating bearing 120. Thus, oil is supplied to the space between the outer circumferential surface of the middle diameter portion 83 of the connecting shaft 80 and the inner circumferential surface of the floating bearing 120. Also, a part on the exhaust side of the middle diameter portion 83 protrudes from the floating bearing 120 toward the exhaust side. A stopper portion 85 protrudes from the part of the middle diameter portion 83 that protrudes from the floating bearing 120. The stopper portion 85 protrudes outward in the radial direction of the connecting shaft 80. The stopper portion 85 extends annularly over the entire area in the circumferential direction of the connecting shaft 80. The outer diameter of the stopper portion 85 is slightly smaller than the inner diameter of the intake-side support hole 52*b* of the support hole 52 and is substantially the same as the outer diameter of the floating bearing 120. The stopper portion 85 is opposed to an exhaust-side end face 125 of the floating bearing 120. The stopper portion 85 of the connecting shaft 80 is located inside the intake-side support hole 52*b* of the support hole 52.

The outer diameter of the small diameter portion 84 of the connecting shaft 80 is smaller than the inner diameter of the insertion hole 41 of the seal plate 40. A stopper bushing 110, which has a tubular shape as a whole, is attached to the end of the small diameter portion 84 adjacent to the middle diameter portion 83. The end on the exhaust side of the stopper bushing 110 contacts the step at the boundary between the small diameter portion 84 and the middle diameter portion 83.

The stopper bushing 110 includes a bushing body 111, which has a substantially cylindrical shape extending in the rotation axis direction. The outer diameter of the bushing body 111 is smaller than the inner diameter of the intake-side support hole 52*b* of the support hole 52 and is slightly smaller than the inner diameter of the insertion hole 41 of the seal plate 40. The inner diameter of the bushing body 111 is substantially the same as the outer diameter of the small diameter portion 84 of the connecting shaft 80. The bushing body 111 is fixed to the small diameter portion 84 and rotates integrally with the small diameter portion 84. In the present embodiment, when facing the intake side from the exhaust side, the connecting shaft 80 rotates toward a first side in the circumferential direction of the connecting shaft 80 (the clockwise side).

A stopper annular portion 112 protrudes from the end on the exhaust side of the outer circumferential surface of the bushing body 111. The stopper annular portion 112 protrudes outward in the radial direction of the connecting shaft 80. That is, the stopper annular portion 112 protrudes radially outward from the outer circumferential surface of the shaft body 81 of the connecting shaft 80, The stopper annular portion 112 extends annularly over the entire area in the circumferential direction of the connecting shaft 80. The outer diameter of the stopper annular portion 112 is slightly smaller than the inner diameter of the intake-side support hole 52*b* of the support hole 52 and is substantially the same as the outer diameter of the floating bearing 120. The stopper annular portion 112 is opposed to an intake-side end face 128 of the floating bearing 120. The stopper annular portion 112 on the connecting shaft 80 is located inside the intake-side support hole 52*b* of the support hole 52.

An annular portion 113 protrudes from the central portion in the rotation axis direction of the outer circumferential surface of the bushing body 111. The annular portion 113 protrudes outward in the radial direction of the connecting shaft 80. The annular portion 113 extends annularly over the entire area in the circumferential direction of the connecting shaft 80. The annular portion 113 is spaced apart from the stopper annular portion 112 in the rotation axis direction. Accordingly, an annular groove 114, which is a substantially annular space, is defined between the annular portion 113 and the stopper annular portion 112. The annular groove 114 is located inside the intake-side support hole 52*b* of the support hole 52. Thus, the radially outer side of the annular groove 114 is defined by the inner circumferential surface of the intake-side support hole 52*b* of the support hole 52.

A first recess 111*a* is disposed at the end on the intake side of the outer circumferential surface of the bushing body 111 and is recessed inward in the radial direction of the connecting shaft 80. The first recess 111*a* extends annularly over the entire area in the circumferential direction of the connecting shaft 80. A first sealing ring 101 is attached to the first recess 111*a*. The first sealing ring 101 limits entry of intake air from the compressor housing 30 into the bearing housing 50. The first sealing ring 101 is annular. The outer diameter of the first sealing ring 101 is substantially the same as the inner diameter of the insertion hole 41 of the seal plate 40.

Also, a second recess 111*b* is disposed at the end on the intake side of the outer circumferential surface of the bushing body 111. The second recess 111*b* is located on the exhaust side of the first recess 111*a* and is recessed inward in the radial direction of the connecting shaft 80. The second recess 111*b* extends annularly over the entire area in the circumferential direction of the connecting shaft 80. A second sealing ring 102 is attached to the second recess 111*b*. The second sealing ring 102 limits entry of intake air from the compressor housing 30 into the bearing housing 50. The second sealing ring 102 is annular. The outer diameter of the second sealing ring 102 is substantially the same as the inner diameter of the insertion hole 41 of the seal plate 40.

The end on the intake side of the bushing body 111 of the stopper bushing 110 is inserted into the insertion hole 41 of the seal plate 40. Thus, the first sealing ring 101 is disposed between the outer circumferential surface of the bushing body 111 of the stopper bushing 110 and the inner circumferential surface of the insertion hole 41 of the seal plate 40. Also, the second sealing ring 102 is disposed between the outer circumferential surface of the bushing body 111 of the stopper bushing 110 and the inner circumferential surface of the insertion hole 41 of the seal plate 40. The second sealing ring 102 is located on the exhaust side of the first sealing ring 101. A part of the intake-side portion of the small diameter portion 84 is located in the accommodation space 32 of the compressor housing 30.

Figure 10B:
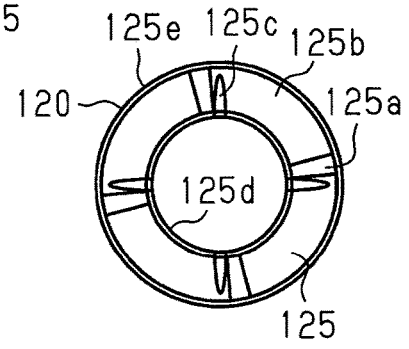
FIG. 10B is a cross-sectional view of the floating bearing.

As shown in FIG. 10B, the end face 125 of the floating bearing 120 includes, as major parts, four land surfaces 125*a*, which are opposed to the stopper portion 85 of the connecting shaft 80, and four tapered surfaces 125*b*, which are inclined relative to the land surfaces 125*a*.

The land surfaces 125*a* are flat surfaces orthogonal to the rotation axis 80*a* of the connecting shaft 80. The land surfaces 125*a* are spaced apart from each other in the circumferential direction of the connecting shaft 80. The four land surfaces 125*a* are equally spaced apart in the circumferential direction of the connecting shaft 80. Some of the reference numerals are omitted in FIG. 10B.

Each tapered surface 125*b* is located between the land surfaces 125*a* that are adjacent to each other in the circumferential direction of the connecting shaft 80. That is, the tapered surfaces 125*b* are arranged in the circumferential direction of the connecting shaft 80. Also, each tapered surfaces 125*b* is adjacent to the land surfaces 125*a* in the circumferential direction of the connecting shaft 80. That is, the land surfaces 125*a* and the tapered surfaces 125*b* are connected in the circumferential direction of the connecting shaft 80. The tapered surfaces 125*b* are recessed in the rotation axis direction with respect to the land surfaces 125*a*. Also, each tapered surface 125*b* becomes shallower toward a first side in the circumferential direction, which is the leading side in the rotation direction of the connecting shaft 80 (the clockwise side in FIG. 10B). That is, each tapered surface 125*b* is inclined to approach the stopper portion 85 in the rotation axis direction toward the first side in the circumferential direction of the connecting shaft 80. Also, the edge of each tapered surfaces 125*b* on the first side in the circumferential direction of the connecting shaft 80 is flush with the land surface 125*a*.

A groove 125*c* recessed in the rotation axis direction is provided in each tapered surface 125*b*. Each groove 125*c* is located at the edge of the tapered surface 125*b* on a second side in the circumferential direction (the counterclockwise side in FIG. 10B). The second side refers to the side opposite to the leading side in the rotation direction of the connecting shaft 80. Each groove 125*c* extends linearly and outward in the radial direction of the connecting shaft 80 from an inner periphery 125*d* of the end face 125. Each groove 125*c* becomes shallower toward the outer end in the radial direction of the connecting shaft 80, and the depth becomes zero before reaching the radially outer edge of the tapered surface 125*b*. That is, the outer end of each groove 125*c* in the radial direction of the connecting shaft 80 does not reach an outer periphery 125*e* of the end face 125. Since the end face 128 of the floating bearing 120 has the same configuration as the end face 125, the description of the end face 128 of the floating bearing 120 will be omitted.

As shown in FIG. 7, the oil discharge space 54 includes an intake-side end space 54*a* located at the end on the intake side, a center space 54*b* located at the center in the rotation axis direction, and an exhaust-side end space 54*c* located at the end on the exhaust side. The center space 54*b* is entirely located below the connecting shaft 80.

The intake-side end space 54*a* reaches a position above the connecting shaft 80. Also, the intake-side end space 54*a* spreads to encompass the stopper bushing 110 on the connecting shaft 80 from the radially outer side and has an annular shape as a whole.

The exhaust-side end space 54*c* reaches a position above the connecting shaft 80. Also, the exhaust-side end space 54*c* spreads to encompass, from the radially outer side, a part of the middle diameter portion 83 of the connecting shaft 80 that is on the exhaust side of the stopper portion 85 and has an annular shape as a whole.

The oil discharge space 54 includes an intake-side annular space 54*d*, which extends upward from an intake-side portion of the center space 54*b* of the oil discharge space 54. The intake-side annular space 54*d* is defined to encompass the end on the intake side of the floating bearing 120 from the radially outer side and has an annular shape as a whole. The intake-side annular space 54*d* is connected to the space between the end face 128 of the floating bearing 120 and the stopper annular portion 112 of the stopper bushing 110 on the connecting shaft 80.

The oil discharge space 54 includes an exhaust-side annular space 54*e*, which extends upward from an exhaust-side portion of the center space 54*b* of the oil discharge space 54. The exhaust-side annular space 54*e* is defined to encompass the end on the exhaust side of the floating bearing 120 from the radially outer side and has an annular shape as a whole. The exhaust-side annular space 54*e* is connected to the space between the end face 125 of the floating bearing 120 and the stopper portion 85 of the connecting shaft 80.

<Specific Configuration of Compressor Wheel 70 and Compressor Housing 30>

The specific configurations of the compressor wheel 70 and the compressor housing 30 will now be described.

As shown in FIG. 11, the compressor wheel 70 has a shaft portion 73, which extends in the rotation axis direction and has a cylindrical shape as a whole. The inner diameter of the shaft portion 73 is substantially the same as the outer diameter of the small diameter portion 84 of the connecting shaft 80. The small diameter portion 84 of the connecting shaft 80 is inserted into the shaft portion 73. The shaft portion 73 is fixed to the small diameter portion 84 of the connecting shaft 80 with a nut 76.

Six blades 71 protrude from the outer circumferential surface of the shaft portion 73. The blades 71 protrude outward in the radial direction of the connecting shaft 80. The blades 71 extend substantially over the entire shaft portion 73 in the rotation axis direction. When facing the intake side from the exhaust side, each blade 71 is curved to shift to the clockwise side in the circumferential direction of the connecting shaft 80 toward the intake side. The blades 71 are spaced apart from each other in the circumferential direction of the connecting shaft 80. The blades 71 are arranged to be equally spaced apart in the circumferential direction of the connecting shaft 80.

Six auxiliary blades 72 protrude from the outer circumferential surface of the shaft portion 73. The auxiliary blades 72 protrude outward in the radial direction of the connecting shaft 80. Each auxiliary blade 72 is located between two of the blades 71 that are arranged in the circumferential direction of the connecting shaft 80. In the present embodiment, the number of the auxiliary blades 72, which is six, corresponds to the number of the blades 71. The auxiliary blades 72 have a length in the rotation axis direction shorter than that of the blades 71. The end on the intake side of each auxiliary blade 72 is located substantially at the center in the rotation axis direction of the shaft portion 73. Thus, the ends on the intake side of the blades 71 are located on the intake side of the ends on the intake side of the auxiliary blades 72. When facing the intake side from the exhaust side, each auxiliary blade 72 is curved to shift to the clockwise side in the circumferential direction of the connecting shaft 80 toward the intake side.

Figure 6:
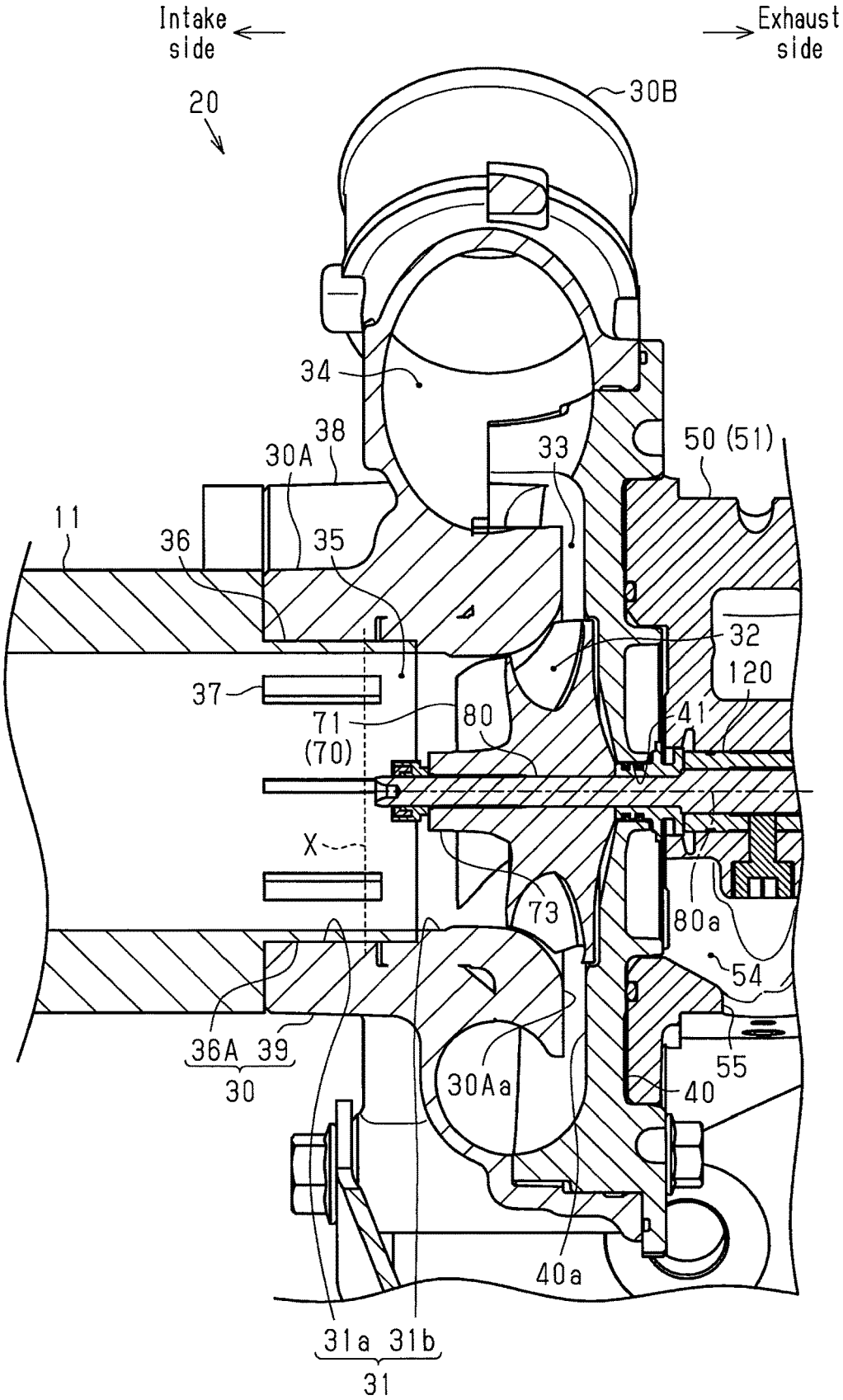
FIG. 6 is a partial cross-sectional view taken along line 6-6 of FIG. 9.

As shown in FIG. 6, the insertion hole 31 includes a small diameter portion 31*b*, which extends toward the intake side from the accommodation space 32 of the housing body 39, in which the compressor wheel 70 is arranged. The insertion hole 31 also includes a large diameter portion 31*a*, which extends to the intake side from the small diameter portion 31*b*. The large diameter portion 31*a* reaches the end of the tubular portion 30A. That is, the large diameter portion 31*a* of the insertion hole 31 opens to the outside of the housing body 39. The inner diameter of the large diameter portion 31*a* is greater than the inner diameter of the small diameter portion 31*b*.

An inlet duct 36A is attached to the large diameter portion 31*a* of the insertion hole 31. The inlet duct 36A is configured to regulate the flow of intake air introduced into the compressor wheel 70. The inlet duct 36A includes a substantially cylindrical tubular member 36. The dimension in the rotation axis direction of the tubular member 36 is substantially the same as the dimension in the rotation axis direction of the large diameter portion 31*a* of the housing body 39. The outer diameter of the tubular member 36 is substantially the same as the inner diameter of the large diameter portion 31*a* of the housing body 39. The inner diameter of the tubular member 36 is substantially the same as the inner diameter of the small diameter portion 31*b* of the housing body 39. The tubular member 36 is fitted in the large diameter portion 31*a* of the housing body 39. The interior space of the tubular member 36, together with the interior space of the small diameter portion 31*b* of the housing body 39, serves as an introduction passage 35, which introduces intake air into the accommodation space 32 of the housing body 39.

As shown in FIG. 6, guide vanes 37 protrude from the inner wall surface of the tubular member 36 (the introduction passage 35). The guide vanes 37 protrude inward in the radial direction of the connecting shaft 80 and have a substantially rectangular shape. The guide vanes 37 extend parallel with the rotation axis direction. In the rotation axis direction, the point at which the distance from the end on the intake side of the tubular member 36 is equal to the distance from the end on the intake side of the blades 71 is defined as a midpoint X. The guide vanes 37 extend from the end on the intake side in the tubular member 36 to a point on the exhaust side of the midpoint X (a position closer to the blades 71). The guide vanes 37 are spaced apart from each other in the circumferential direction of the connecting shaft 80. The number of the guide vanes 37, which is seven, is the smallest odd number that is greater than the number of the blades 71, which is six. The guide vanes 37 are arranged to be equally spaced apart in the circumferential direction of the connecting shaft 80. In the present embodiment, the guide vanes 37 are molded integrally with the tubular member 36 through plastic molding to form an integrally molded member. Also, in the present embodiment, the inlet duct 36A and the housing body 39 constitute the compressor housing 30. The inlet duct 36A is formed integrally with the intake line 11, which is on the upstream side of the compressor housing, through plastic molding.

<Seal Plate 40 and Surrounding Structure>

Next, the assembling structure of the seal plate 40 and the bearing housing 50 will be described.

Figure 5:
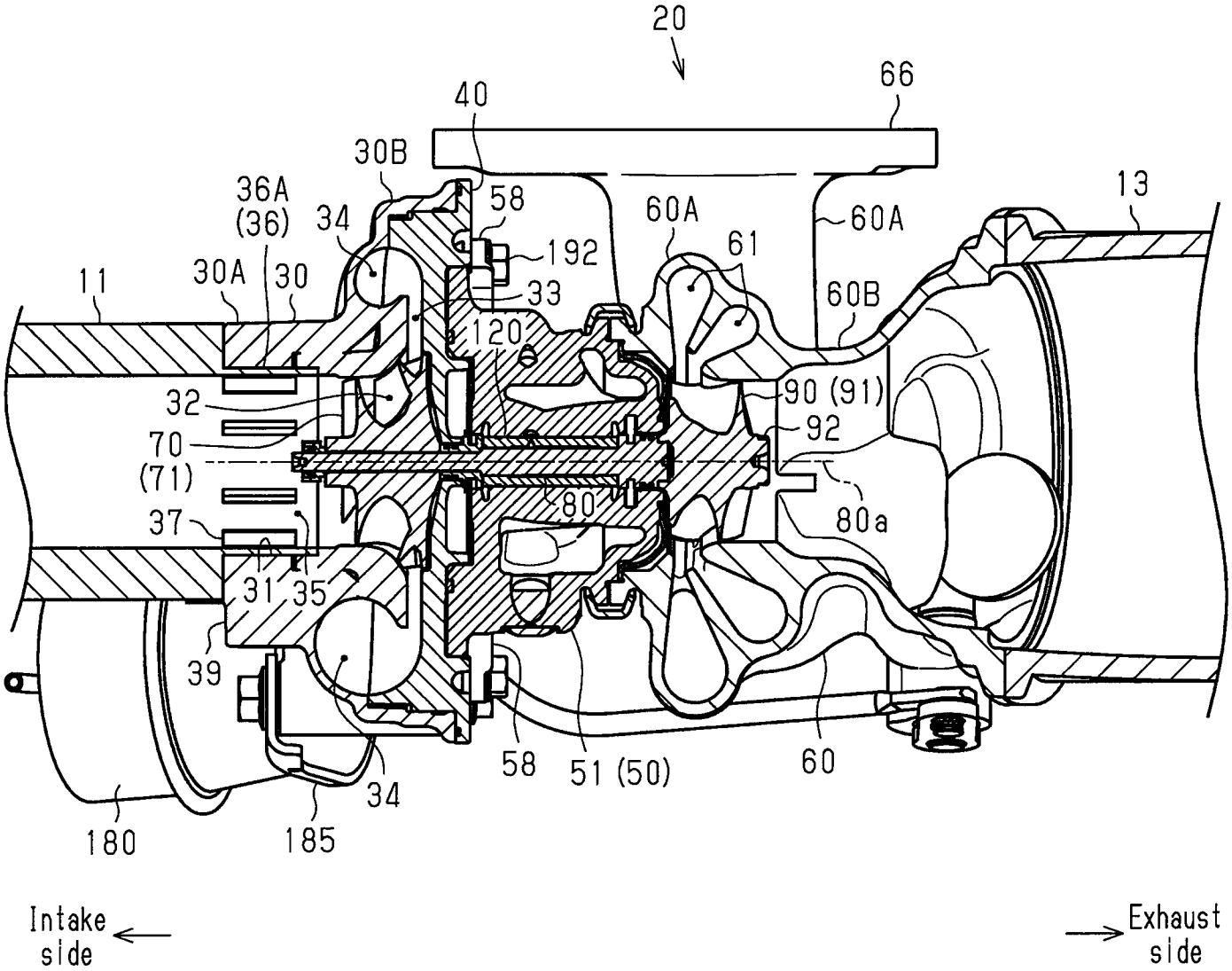
FIG. 5 is a cross-sectional view taken along line 5-5 of FIG. 2.

As shown in FIG. 5, support portions 58 protrude from the end on the intake side of the outer circumferential surface of the main body 51 of the bearing housing 50. The support portions 58, the number of which is three, protrude outward in the radial direction of the connecting shaft 80. The surface of each support portion 58 on the intake side contacts the surface of the seal plate 40 on the exhaust side. That is, the seal plate 40 contacts the support portions 58 of the bearing housing 50 from the intake side. Each support portion 58 has a bolt hole (not shown). Bolts 192 are inserted through the bolt holes to fix the support portions 58 (the bearing housing 50) to the seal plate 40.

As shown in FIG. 9, the support portions 58 are spaced apart from each other in the circumferential direction of the connecting shaft 80. One of the three support portions 58 (the rightmost support portion 58 in FIG. 9) will be referred to as a first support portion 58*a*. One of the three support portions 58 that is different from the first support portion 58*a* (the leftmost support portion 58 in FIG. 9) will be referred to as a second support portion 58*b*. The other one of the three support portions 58 (the uppermost support portion 58 in FIG. 9), which is different from the first support portion 58*a* and the second support portion 58*b*, will be referred to as a third support portion 58*c*. A straight line that is orthogonal to the rotation axis 80*a* of the connecting shaft 80 and extends through the center of the first support portion 58*a* is defined as an imaginary straight line 58*d*.

The first support portion 58*a* is located on a first side in a direction along the imaginary straight line 58*d* (the right lower side in FIG. 9) with respect to the rotation axis 80*a* of the connecting shaft 80. The second support portion 58*b* and the third support portion 58*c* are located on a second side in the direction along the imaginary straight line 58*d* (the left upper side in FIG. 9) with respect to the rotation axis 80*a* of the connecting shaft 80. That is, in the direction along the imaginary straight line 58*d*, the first support portion 58*a* is located on the opposite side of the rotation axis 80*a* of the connecting shaft 80 from the second support portion 58*b*. Also, in the direction along the imaginary straight line 58*d*, the first support portion 58*a* is located on the opposite side of the rotation axis 80*a* of the connecting shaft 80 from the third support portion 58*c*.

<Connecting Structure of Connecting Shaft 80 and Turbine Wheel 90>

Next, the connecting structure of the connecting shaft 80 and the turbine wheel 90 will be described.

As shown in FIG. 7, a substantially columnar connecting portion 86 extends toward the exhaust side from the end on the exhaust side of the large diameter portion 82 of the shaft body 81. The outer diameter of the connecting portion 86 is smaller than the outer diameter of the large diameter portion 82. The boundary between the large diameter portion 82 and the connecting portion 86 is a curved surface that has the shape of a fillet. The turbine wheel 90 is fixed to the connecting portion 86.

As shown in FIG. 11, the turbine wheel 90 has a shaft portion 92, which extends in the rotation axis direction and has a columnar shape as a whole. The outer diameter of the shaft portion 92 is greater than the outer diameter of the connecting portion 86 of the connecting shaft 80 and is substantially the same as the outer diameter of the large diameter portion 82 of the connecting shaft 80.

A substantially columnar connecting recess 93 is recessed toward the exhaust side from the intake-side end face of the shaft portion 92. The inner diameter of the connecting recess 93 is substantially the same as the outer diameter of the connecting portion 86 of the connecting shaft 80. The open edge on the intake side of the connecting recess 93 has a chamfered shape. The connecting portion 86 of the connecting shaft 80 is inserted into the connecting recess 93 of the shaft portion 92. The connecting shaft 80 and the turbine wheel 90 are fixed to each other with the end face on the exhaust side of the large diameter portion 82 of the connecting shaft 80 contacting the end face on the intake side of the shaft portion 92 of the turbine wheel 90. In the present embodiment, the connecting shaft 80 and the turbine wheel 90 are fixed to each other through welding.

Nine blades 91 protrude from the outer circumferential surface of the shaft portion 92. The blades 91 protrude outward in the radial direction of the connecting shaft 80. The blades 91 extend substantially over the entire shaft portion 92 in the rotation axis direction. The blades 91 are spaced apart from each other in the circumferential direction of the connecting shaft 80. The blades 91 are arranged to be equally spaced apart in the circumferential direction of the connecting shaft 80.

<Connecting Structure of Bearing Housing 50 and Turbine Housing 60>

Next, the connecting structure of the bearing housing 50 and the turbine housing 60 will be described.

As shown in FIG. 7, the main body 51 of the bearing housing 50 includes a connecting portion 51*a*, which is an end on the exhaust side of the clamping flange 59. The outer diameter of the connecting portion 51*a* is smaller than the outer diameter of a portion of the main body 51 that is on the intake side of the clamping flange 59. The connecting portion 51*a* includes, as major parts, a connecting large diameter portion 51*b* and a connecting small diameter portion 51*c*, which has an outer diameter smaller than that of the connecting large diameter portion 51*b*. The connecting large diameter portion 51*b* and the connecting small diameter portion 51*c* are arranged in order from the end on the intake side. A step that extends over the entire area in the circumferential direction of the connecting shaft 80 is provided at the boundary between the connecting large diameter portion 51*b* and the connecting small diameter portion 51*c*. The step is constituted by the end face on the exhaust side of the connecting large diameter portion 51*b*, and the end face functions as a clamping surface 51*d*. The clamping surface 51*d* is a flat surface orthogonal to the rotation axis 80*a* of the connecting shaft 80.

As shown in FIG. 8, the interior space of the tubular portion 60B of the turbine housing 60 includes a connecting hole 67, which is a section that is on the intake side of the accommodation space 62. The connecting portion 51*a* is inserted into the connecting hole 67. As shown in FIG. 7, the connecting hole 67 includes, as major parts, a connecting large diameter hole 67*a* and a connecting small diameter hole 67*b*, which has an inner diameter smaller than that of the connecting large diameter hole 67*a*. The connecting large diameter hole 67*a* and the connecting small diameter hole 67*b* are arranged in order from the end on the intake side. The inner diameter of the connecting large diameter hole 67*a* is substantially the same as the outer diameter of the connecting large diameter portion 51*b*. The inner diameter of the connecting small diameter hole 67*b* is greater than the outer diameter of the connecting small diameter portion 51*c* of the bearing housing 50. A step that extends over the entire area in the circumferential direction of the connecting shaft 80 is provided at the boundary between the connecting large diameter hole 67*a* and the connecting small diameter hole 67*b*. The end face on the intake side of the connecting small diameter hole 67*b* constitutes the step and functions as a clamping surface 67*d*. The clamping surface 67*d* is a flat surface orthogonal to the rotation axis 80*a* of the connecting shaft 80. The connecting portion 51*a* of the bearing housing 50 is inserted into the connecting hole 67 of the turbine housing 60.

The heat shield plate 130, which has an annular shape as a whole, is disposed between the connecting portion 51*a* of the bearing housing 50 and the connecting hole 67 of the turbine housing 60. The heat shield plate 130 has an outer peripheral portion 133, which is an outer portion in the radial direction and has the shape of an annular flat plate. The outer diameter of the outer edge of the outer peripheral portion 133 is smaller than the inner diameter of the connecting large diameter hole 67*a* of the connecting hole 67 of the turbine housing 60. In the thickness direction of the outer peripheral portion 133, the outer peripheral portion 133 is clamped between the clamping surface 51*d* of the connecting portion 51*a* of the bearing housing 50 and the clamping surface 67*d* of the connecting hole 67 of the turbine housing 60. Also, the outer peripheral portion 133, which has the shape of an annular flat plate as described above, is clamped, over the entire area in the circumferential direction of the connecting shaft 80, between the clamping surface 51*d* of the connecting portion 51*a* of the bearing housing 50 and the clamping surface 67*d* of the connecting hole 67 of the turbine housing 60. The inner diameter of the outer peripheral portion 133 is smaller than the diameter of the inner edge of the clamping surface 67*d* of the turbine housing 60. A curved portion 132 extends toward the exhaust side from the inner edge of the outer peripheral portion 133. The curved portion 132 is curved to approach the radial center of the connecting shaft 80 toward the exhaust side. The curved portion 132 extends from the entire inner edge of the outer peripheral portion 133. An inner peripheral portion 131 extends inward in the radial direction of the connecting shaft 80 from the inner edge of the curved portion 132. The inner peripheral portion 131 extends from the entire inner edge of the curved portion 132 and has the shape of an annular flat plate. With the outer peripheral portion 133 of the heat shield plate 130 clamped, the curved portion 132 is elastically deformed in the rotation axis direction, and the inner peripheral portion 131 contacts the end on the exhaust side of the connecting portion 51*a* of the bearing housing 50. Also, the inner peripheral portion 131 of the heat shield plate 130 is disposed between the connecting portion 51*a* of the bearing housing 50 and the blades 91 of the turbine wheel 90.

The clamping flange 59 of the bearing housing 50 has an opposed surface 59*a*, which is the end face on the exhaust side. The opposed surface 59*a* is orthogonal to the rotation axis 80*a* of the connecting shaft 80. The clamping flange 68 of the turbine housing 60 has an opposed surface 68*a*, which is the end face on the intake side. The opposed surface 68*a* is orthogonal to the rotation axis 80*a* of the connecting shaft 80. The opposed surface 59*a* of the clamping flange 59 of the bearing housing 50 and the opposed surface 68*a* of the clamping flange 68 of the turbine housing 60 are opposed to each other in the rotation axis direction. In the entire region in which the opposed surface 59*a* of the clamping flange 59 of the bearing housing 50 and the opposed surface 68*a* of the clamping flange 68 of the turbine housing 60 are opposed to each other in the rotation axis direction, the opposed surface 59*a* and the opposed surface 68*a* are spaced apart from each other in the rotation axis direction so that a clearance exists in between.

<Wastegate 150 and Surrounding Structure>

Next, the bypass passages 64 of the turbine housing 60 and the wastegate 150 will be described.

As shown in FIG. 8, the turbine housing 60 has the two bypass passages 64 defined therein in correspondence with the two scroll passages 61 (only one of the bypass passages 64 is shown in FIG. 8). The two bypass passages 64 are opened to the interior of the turbine housing 60, and the openings are arranged side by side. A valve seat 65 is provided in a section of the inner wall of the turbine housing 60 around the open edges of outlet portions 64*a* of the bypass passages 64. In the present embodiment, the valve seat 65 has a cylindrical shape protruding from the inner wall surface of the turbine housing 60, and the outlet portions 64*a* of the two bypass passages 64 are defined in the valve seat 65. The valve seat 65 has a flat end face, which is a contact surface 65*a*.

As shown in FIG. 13, a through-hole 69 extends through the wall of the tubular portion 60B of the turbine housing 60. The through-hole 69 is located at a position on the downstream side of the valve seat 65 in the turbine housing 60. The central axis of the through-hole 69 is parallel with the contact surface 65*a* of the valve seat 65. A cylindrical bushing 160 is inserted into the through-hole 69. The outer diameter of the bushing 160 is substantially the same as the inner diameter of the through-hole 69. The central axis of the bushing 160 is coaxial with the central axis of the through-hole 69.

As shown in FIG. 13, the wastegate 150, which selectively opens and closes the bypass passages 64, is attached to the turbine housing 60. The shaft 151 of the wastegate 150 is substantially columnar. The outer diameter of the shaft 151 is substantially the same as the inner diameter of the bushing 160. The shaft 151 is inserted into the bushing 160 and rotationally supported by the turbine housing 60. The shaft 151 has a rotation axis 151*a* that is coaxial with the central axis of the through-hole 69. As described above, the through-hole 69 is located at a position on the downstream side of the valve seat 65 in the turbine housing 60. Thus, in a direction orthogonal to the contact surface 65*a* of the valve seat 65, the rotation axis 151*a* of the shaft 151 is spaced apart from the contact surface 65*a* of the valve seat 65 toward the downstream side in the flowing direction of exhaust gas flowing through the bypass passages 64.

A connection portion 153 of the valve member 152 extends outward in the radial direction of the shaft 151 from the end of the shaft 151 inside the turbine housing 60. As shown in Fig. FIG. 12C, a substantially disk-shaped valve main body 154 is attached to the connection portion 153. A surface of the valve main body 154 on the opposite side from the connection portion 153 functions as a contact surface 154*a*, which intersects with the circumferential direction of the shaft 151 and is opposed to the valve seat 65 of the turbine housing 60. The entire contact surface 154*a* of the valve main body 154 is flat. The dimension of the connection portion 153 in a direction orthogonal to the contact surface 154*a* of the valve main body 154 increases toward the shaft 151 (toward the left side in the FIG. 12C). In the present embodiment, the shaft 151 and the valve member 152 are formed integrally through casting. Thus, the wastegate 150 is an integrally molded member that includes the shaft 151 and the valve member 152, which are integrated.

As shown in FIG. 2, the end of the shaft 151 of the wastegate 150 outside the turbine housing 60 is coupled to the link mechanism 170. Specifically, the shaft 151 is coupled to a first end of a substantially rectangular plate-shaped link arm 171. A second end of the link arm 171 is coupled to a first end of a link rod 172, which is shaped like a bar as a whole. Thus, in the radial direction of the shaft 151, a connection center 177 of the link rod 172 and the link arm 171 is separated from a connection center 176 of the link arm 171 and the shaft 151. The link rod 172 extends from the exhaust side toward the intake side as a whole. A second end of the link rod 172 is coupled to the output shaft of the actuator 180.

When the actuator 180 operates and moves the link rod 172 toward a first side in the longitudinal direction of the link rod 172 (leftward) as shown in FIG. 2, the link arm 171 converts the motion of the link rod 172 into rotation and rotates toward a first side in the circumferential direction of the shaft 151 (the counterclockwise side). The wastegate 150 is then rotated toward the first side in the circumferential direction of the shaft 151. This causes the contact surface 154*a* of the valve member 152 to contact the contact surface 65*a* of the valve seat 65 of the turbine housing 60. Accordingly, the downstream ends of the bypass passages 64 are covered by the valve member 152 of the wastegate 150, so that the bypass passages 64 are in a fully closed state. In the present embodiment, the fully closed state refers to a state in which the contact surface 154*a* of the valve member 152 and the contact surface 65*a* of the valve seat 65 contact each other, so that the wastegate 150 cannot rotate further in the closing direction. In the present embodiment, when the bypass passages 64 are in the fully closed state as shown in FIG. 13, an imaginary straight line 172*a* extending in the longitudinal direction of the link rod 172 intersect with an imaginary plane 65*b* that is parallel with the contact surface 65*a* of the valve seat 65.

In contrast, when the actuator 180 operates and moves the link rod 172 toward a second side in the longitudinal direction of the link rod 172 (rightward) as shown in FIG. 2, the link arm 171 converts the motion of the link rod 172 into rotation and rotates toward a second side in the circumferential direction of the shaft 151 (the clockwise side). The wastegate 150 is then rotated toward the second side in the circumferential direction of the shaft 151. This causes the contact surface 154*a* of the valve member 152 to separate from the contact surface 65*a* of the valve seat 65 of the turbine housing 60. Accordingly, the downstream ends of the bypass passages 64 are no longer covered by the valve member 152 of the wastegate 150, so that the bypass passages 64 are in an open state.

Figure 12A:
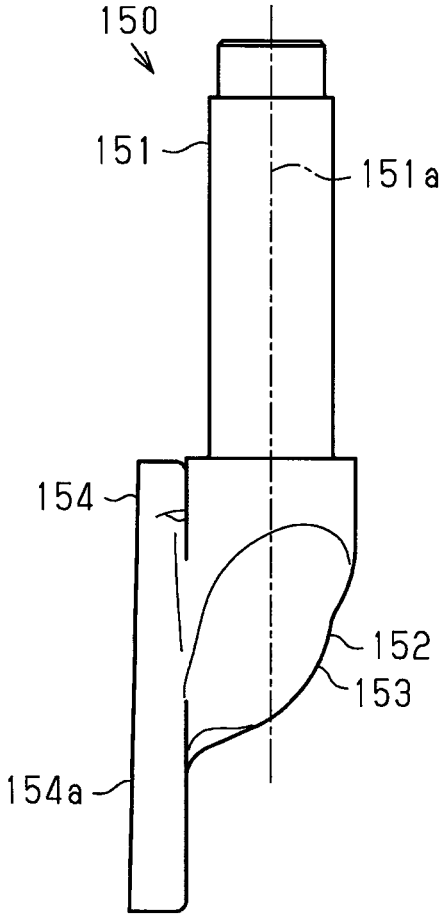
FIG. 12A is a side view of a wastegate.

As shown in FIG. 12A, the contact surface 154*a* of the valve member 152 is inclined to shift outward in the radial direction of the shaft 151 (leftward) relative to the rotation axis 151*a* as the (downward) distance from the link arm 171 increases in the rotation axis direction of the shaft 151. Thus, when the bypass passages 64 are in the fully closed state, the ontact surface 154*a* of the valve member 152 is inclined to shift toward the first side in the longitudinal direction of the link rod 172 with respect to the rotation axis 151*a* of the shaft 151 (toward the valve seat 65) as the distance from the link arm 171 increases in the rotation axis direction of the shaft 151. In the present embodiment, the contact surface 154*a* of the valve member 152 is inclined by an angle less than or equal to 1 degree with respect to the rotation axis 151*a* of the shaft 151. In FIG. 12A, the inclination of the contact surface 154*a* of the valve member 152 with respect to the rotation axis 151*a* of the shaft 151 is exaggerated.

Figure 12B:
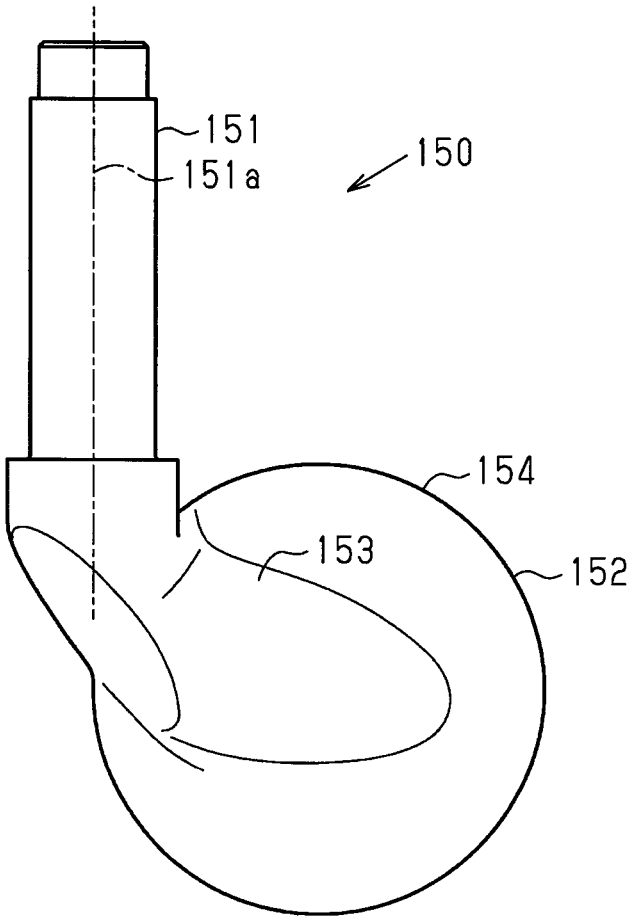
FIG. 12B is a front view of the wastegate.
Figure 12C:
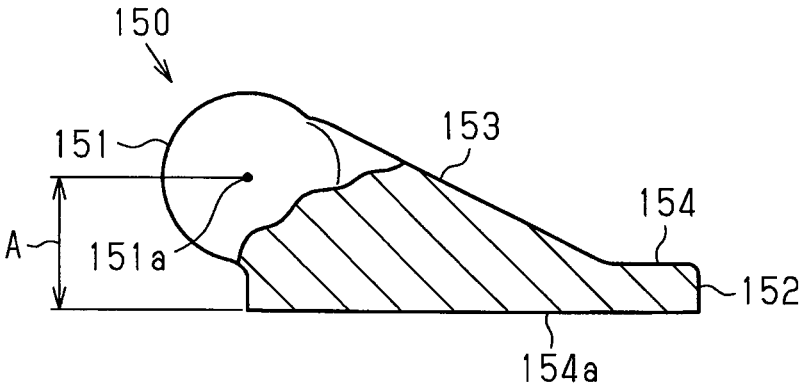
FIG. 12C is a bottom view of the wastegate.

In a cross section that is orthogonal to the rotation axis 151*a* of the shaft 151 and includes the contact surface 65*a* of the valve seat 65, the longest distance from the contact surface 154*a* of the valve member 152 to the rotation axis 151*a* of the shaft 151 in a direction orthogonal to the contact surface 154*a* of the valve member 152 will be referred to as a distance A as shown in FIG. 12C. Also, in a cross section that is orthogonal to the rotation axis 151*a* of the shaft 151 and includes the contact surface 65*a* of the valve seat 65, the distance from the contact surface 65*a* of the valve seat 65 to the rotation axis 151*a* of the shaft 151 in a direction orthogonal to the contact surface 65*a* of the valve seat 65 will be referred to as a distance B as shown in FIG. 13. In the present embodiment, the position of the contact surface 154*a* of the valve main body 154 with respect to the contact surface 65*a* of the valve seat 65 is designed such that the distance A is shorter than the distance B.

<Configuration of Bypass Passages 64 and Catalyst 15>

Next, the positional relationship between the bypass passages 64 and the catalyst 15 will be described.

As shown in FIG. 8, the catalyst 15 includes a tubular portion 16, which extends linearly from the upstream side toward the downstream side in the exhaust line 13. The tubular portion 16 is cylindrical. The tubular portion 16 has partition walls 17, which divide the interior space of the tubular portion 16. The partition walls 17 extend parallel with the central axis 16*a* of the tubular portion 16 from the upstream end to the downstream end of the tubular portion 16. The partition walls 17 include first partition walls 17*a*, which extend in a first direction orthogonal to the central axis 16*a* of the tubular portion 16, and second partition walls 17*b*, which extend in a second direction, which is orthogonal to the first direction. Thus, when viewed in a direction along the central axis 16*a* of the tubular portion 16, the first partition walls 17*a* and the second partition walls 17*b* form a lattice pattern. In FIG. 8, the number of the partition walls 17 is less than the actual number to simplify the illustration of the catalyst 15.

The center of the upstream end of the catalyst 15 is located on central axes 64*b* of the outlet portions 64*a* of the bypass passages 64. The central axes 64*b* of the outlet portions 64*a* of the bypass passages 64 intersect with the first partition walls 17*a* of the catalyst 15. As shown in FIG. 8, when viewed in a direction orthogonal to the central axes 64*b* of the outlet portions 64*a* of the bypass passages 64 and orthogonal to the central axis 16*a* of the tubular portion 16 of the catalyst 15, an acute angle C defined by the central axes 64*b* of the outlet portions 64*a* of the bypass passages 64 and the central axis 16*a* of the tubular portion 16 of the catalyst 15 is 30 degrees. In the present embodiment, the outlet portions 64*a* of the two bypass passages 64 extend to be parallel with each other.

<Manufacturing Method for Welding Turbine Wheel 90 and Connecting Shaft 80>

A manufacturing method for welding the contacting portions of the end on the intake side of the shaft portion 92 of the turbine wheel 90 and the end on the exhaust side of the large diameter portion 82 of the connecting shaft 80 to each other will be described. First, a welding apparatus 200 used in the welding will be described.

Figure 14:
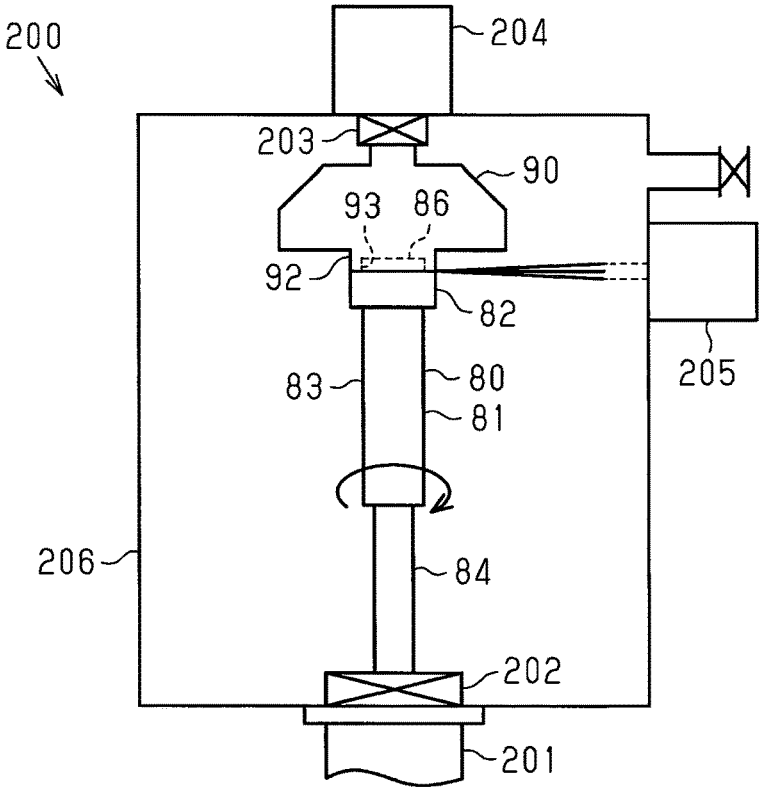
FIG. 14 is a diagram illustrating a manufacturing process.

As shown in FIG. 14, the welding apparatus 200 includes a lift 201, which is configured to adjust the welding position of the turbine wheel 90 and the connecting shaft 80. The upper surface of the lift 201 can be lifted or lowered by an actuator (not shown). A lower chuck 202 is attached to the upper surface of the lift 201. The lower chuck 202 is configured to support the end on the intake side of the connecting shaft 80. The lower chuck 202 is rotational relative to the lift 201. The rotation axis of the lower chuck 202 extends in the vertical direction. A vacuum chamber 206, which is configured to define a vacuum space, is attached to the upper surface of the lift 201. The interior of the vacuum chamber 206 is made substantially vacuum by removing air from the inside of the vacuum chamber 206. An upper chuck 203, which is configured to support the end on the exhaust side of the turbine wheel 90, is attached to the upper part of the vacuum chamber 206. The upper chuck 203 is located above the lower chuck 202 in the vertical direction. The upper chuck 203 is coaxial with the lower chuck 202 and is rotational relative to the vacuum chamber 206. The upper chuck 203 is coupled to an electric motor 204. When operating, the electric motor 204 rotates the turbine wheel 90, which is supported by the upper chuck 203, and the connecting shaft 80. An electron gun 205, which is configured to project an electron beam, is attached to the side of the vacuum chamber 206.

The manufacturing method for welding the contacting portions of the end on the intake side of the shaft portion 92 of the turbine wheel 90 and the end on the exhaust side of the large diameter portion 82 of the connecting shaft 80 to each other will be illustrated.

First, the connecting portion 86 of the connecting shaft 80 is inserted into the connecting recess 93 of the shaft portion 92 of the turbine wheel 90. Next, the end on the intake side (lower end) of the connecting shaft 80 is supported by the lower chuck 202, and the end on the exhaust side (upper end) of the turbine wheel 90 is supported by the upper chuck 203. Then, air is removed from the inside of the vacuum chamber 206 to substantially vacuumize the interior of the vacuum chamber 206.

Subsequently, the electron gun 205 is arranged at a position outward of, in the radial direction of the connecting shaft 80, the contacting portions of the end on the intake side of the shaft portion 92 of the turbine wheel 90 and the end on the exhaust side of the large diameter portion 82 of the connecting shaft 80. The electron gun 205 is caused to project an electron beam (for example, the current is several mA, and the voltage is several tens of kV). While causing the electron gun 205 to project the electron beam, the turbine wheel 90 and the connecting shaft 80 are rotated one turn about the rotation axis 80*a* of the connecting shaft 80 (taking several seconds, for example) to perform temporary welding.

The power of the electron beam projected by the electron gun 205 is increased (for example, the current is several tens of mA, and the voltage is several tens of kV). The electron gun 205 is then arranged at a position outward of, in the radial direction of the connecting shaft 80, the contacting portions of the end on the intake side of the shaft portion 92 of the turbine wheel 90 and the end on the exhaust side of the large diameter portion 82 of the connecting shaft 80. The electron gun 205 is caused to project an electron beam While causing the electron gun 205 to project the electron beam, the turbine wheel 90 and the connecting shaft 80 are rotated one turn about the rotation axis 80*a* of the connecting shaft 80 (taking several seconds, for example) to perform production welding.

Next, the power of the electron beam projected by the electron gun 205 is reduced (for example, the current is several mA, and the voltage is several tens of kV). The electron gun 205 is then arranged at a position outward of, in the radial direction of the connecting shaft 80, the contacting portions of the end on the intake side of the shaft portion 92 of the turbine wheel 90 and the end on the exhaust side of the large diameter portion 82 of the connecting shaft 80. The electron gun 205 is caused to project an electron beam While causing the electron gun 205 to project the electron beam, the turbine wheel 90 and the connecting shaft 80 are rotated one turn about the rotation axis 80*a* of the connecting shaft 80 (taking several seconds, for example) to perform tempering.

In the process of temporary welding, the coupling strength of the shaft portion 92 of the turbine wheel 90 and the large diameter portion 82 of the connecting shaft 80 is less than the coupling strength that can withstand the operation of the turbocharger 20. Also, in the process of tempering, the shaft portion 92 of the turbine wheel 90 and the large diameter portion 82 of the connecting shaft 80 are not melted. Thus, in the process of production welding in the present embodiment, welding is performed only once to achieve the coupling strength of the shaft portion 92 of the turbine wheel 90 and the large diameter portion 82 of the connecting shaft 80 that withstands the operation of the turbocharger 20.

The operation and advantages of the present embodiment will now be described.

(1) Advantages Related to Guide Vanes 37 and Surrounding Structure (1-1) In the turbocharger 20, when the compressor wheel 70 in the compressor housing 30 rotates, the intake air that is drawn in from the section of the intake line 11 on the upstream side of the compressor housing 30 is discharged to the section of the intake line 11 on the downstream side of the compressor housing 30 via the accommodation space 32, the connection passage 33, and the scroll passage 34.

As shown in FIG. 6, the guide vanes 37 protrude from the inner wall surface of the tubular member 36 (the introduction passage 35) in the compressor housing 30. The guide vanes 37 protrude inward in the radial direction of the connecting shaft 80 and have a substantially rectangular shape. Thus, in a radially outer section of the introduction passage 35, the intake air does not flow in the section of the introduction passage 35 where the guide vanes 37 are provided. The intake air flows through sections between each adjacent pair of the guide vanes 37 in the introduction passage 35, which generates intake air streams the number of which corresponds to the number of the guide vanes 37. On the downstream side of the guide vanes 37 in the introduction passage 35, the flow of the intake air is strong in the sections where the intake air streams are generated, and the flow of the intake air is weak in the sections where the intake air streams are not generated. That is, the strength of the flow of the intake air varies in the circumferential direction of the introduction passage 35. In this case, the sections in which intake air streams are generated and the intake flow is strong strike the blades 71 of the compressor wheel 70. This generates vibration in the entire compressor wheel 70.

It is now assumed that the number of the guide vanes 37 is seven, which is the same as the number of the blades 71 of the compressor wheel 70. In this case, the number of the intake air streams is seven in correspondence with the number of the blades 71 of the compressor wheel 70. Thus, the intake air streams, which flow downstream from the introduction passage 35, strike the ends on the intake side of the blades 71 of the compressor wheel 70, substantially simultaneously. Vibrations generated by the intake air streams striking the ends on the intake side of the blades 71 coincide. This may generate excessively strong vibration of the compressor wheel 70.

In the present embodiment, the number of the guide vanes 37, which is seven, is the smallest odd number that is greater than the number of the blades 71, which is six. That is, the number of the guide vanes 37 is neither the same as the number of the blades 71 of the compressor wheel 70 nor a multiple of the number of the blades 71. Thus, the intake air streams do not strike the ends on the upstream side of the blades 71 of the compressor wheel 70 simultaneously, so that vibrations that are generated by the intake air streams striking the ends on the upstream side of the respective blades 71 are not generated simultaneously. Accordingly, the vibrations generated by the intake air streams striking the ends on the upstream side of the blades 71 interfere with each other. This is likely to attenuate the vibration of the compressor wheel 70 as a whole.

Since the number of the guide vanes 37 is greater than the number of the blades 71, the number of intake air streams the number of which corresponds to the number of the guide vanes 37 is greater than that in the ease in which the number of the guide vanes 37 is smaller than the number of the blades 71. This reduces the vibration of each blade 71 generated by the intake air stream striking the blade 71. Further, since the number of the guide vanes 37 is the smallest odd number that is greater than the number of the blades 71, which is the minimum necessary number, increase in the intake resistance due to the guide vanes 37 is minimized.

(1-2) The ends on the intake side of the blades 71 are located on the intake side of the ends on the intake side of the auxiliary blades 72. When intake air flows to the accommodation space 32 from the introduction passage 35, the compressor wheel 70 is rotating. Thus, most of the intake air flowing to the accommodation space 32 from the introduction passage 35 strikes the ends on the upstream side of the blades 71. Accordingly, most of the vibration generated by the intake air streams striking the compressor wheel 70 is generated by the intake air streams striking the blades 71. Thus, the relationship between the number of the guide vanes 37 and the number of the auxiliary blades 72 has a significantly small influence on the vibration of the compressor wheel 70. In the present embodiment, since the number of the guide vanes 37 is set with reference to the number of the blades 71, the number of the guide vanes 37 is not changed by the number of the auxiliary blades 72. Thus, the number of the guide vanes 37 is not increased in correspondence With the number of the auxiliary blades 72. This prevents the intake resistance from being increased by an increased in the number of the guide vanes 37.

(1-3) The guide vanes 37 extend from the end on the intake side in the tubular member 36 to a point on the exhaust side of the midpoint X (a position closer to the blades 71). Thus, in the present embodiment, the flow regulating effect of the guide vanes 37 is greater than that in a case in which the ends on the exhaust side of the guide vanes 37 are located on the intake side of the midpoint X. Since the distance between the end on the exhaust side of the guide vane 37 and the end on the intake side of the blades 71 is relatively small, the regulated flow of intake air readily reaches the blades 71 without being diffused. When the regulated flow of intake air reaches the blades 71 without being diffused, the strength of the flow of the intake air greatly varies in the circumferential direction. The vibration of the blade 71 generated by the part of the strong flow of the intake air striking the blade 71 tends to be great. By setting the number of the guide vanes 37 having such characteristics in the above described manner, the effect of suppressing vibrations of the compressor wheel 70 is effectively achieved.

(1-4) The inlet duct 36A is configured as a member separate from the housing body 39, and the tubular member 36 of the inlet duct 36A is fitted in the large diameter portion 31*a* of the housing body 39. The guide vanes 37 and the tubular member 36 in the inlet duct 36A form an integrally molded member. Thus, it is possible to form the guide vanes 37 in the compressor housing 30 simply by fitting the tubular member 36 of the inlet duct 36A into the large diameter portion 31*a* of the housing body 39. Since the guide vanes 37 are not formed in the housing body 39, the shape of the housing body 39 is prevented from being complicated.

(2) Regarding Advantages Related to Connecting Shaft 80 and Surrounding Structure (2-1) As shown in FIG. 7, the first sealing member 106 is disposed between the outer circumferential surface of the large diameter portion 82 of the connecting shaft 80 and the inner circumferential surface of the support hole 52 of the bearing housing 50. The first sealing member 106 limits entry of exhaust gas flowing through the accommodation space 62 of the turbine housing 60 into the oil discharge space 54 of the bearing housing 50.

The pressure of the exhaust gas inside the turbine housing 60 may become excessively high depending on the operating state of the internal combustion engine 10. In such a case, the exhaust gas flowing through the accommodation space 62 of the turbine housing 60 may flow into a section on the intake side of the first sealing member 106 of the space between the outer circumferential surface of the large diameter portion 82 of the connecting shaft 80 and the inner circumferential surface of the support hole 52 of the bearing housing 50.

In the present embodiment, the second sealing member 107 is disposed between the outer circumferential surface of the large diameter portion 82 of the connecting shaft 80 and the inner circumferential surface of the exhaust-side support hole 52*a* of the support hole 52. The second sealing member 107 is located on the intake side of the first sealing member 106. Thus, even if exhaust gas flows into a section on the intake side of the first sealing member 106 of the space between the outer circumferential surface of the large diameter portion 82 of the connecting shaft 80 and the inner circumferential surface of the support hole 52 of the bearing housing 50, entry of exhaust gas into the section on the intake side of the second sealing member 107 is limited.

(2-2) The first sealing member 106 and the second sealing member 107 extend over approximately 359 degrees in the circumferential direction of the connecting shaft 80 and each have a slit in a part. Thus, exhaust gas may flow into a section on the intake side of the first sealing member 106 through the gap at the slit of the first sealing member 106 between the outer circumferential surface of the large diameter portion 82 of the connecting shaft 80 and the inner circumferential surface of the support hole 52 of the bearing housing 50.

In the present embodiment, when viewed in the rotation axis direction, at least one of the first sealing member 106 and the second sealing member 107 exists at any position in the entire area in the circumferential direction of the connecting shaft 80. In this manner, the first sealing member 106 and the second sealing member 107 are located on the opposite sides of the connecting shaft 80. Thus, even if exhaust gas flows into a section on the intake side of the first sealing member 106 through the gap at the slit of the first sealing member 106, the second sealing member 107 limits entry of exhaust gas.

Particularly, in the present embodiment, when viewed in the rotation axis direction, the second sealing member 107 is installed such that its slit in the C-shape is separated from the slit of the C-shape of the first sealing member 106 by 180 degrees. Thus, in the space between the outer circumferential surface of the large diameter portion 82 of the connecting shaft 80 and the inner circumferential surface of the support hole 52 of the bearing housing 50, a sufficient distance is ensured between the slit of the C-shape of the first sealing member 106 and the slit of the C-shape of the second sealing member 107.

(2-3) In the present embodiment, since the first sealing member 106 is located on the exhaust side of the second sealing member 107, the first sealing member 106 is more likely to be exposed to exhaust gas than the second sealing member 107. Thus, the first sealing member 106 may be degraded by the heat of exhaust gas.

As shown in FIG. 7, the end on the exhaust side of the hearing housing 50 in the coolant passage 56 reaches a position on the exhaust side of the second sealing member 107. Thus, the heat exchange with the coolant flowing through the coolant passage 56 cools a section of the bearing housing 50 in the vicinity of the first sealing member 106 in addition to a section of the bearing housing 50 in the vicinity of the second sealing member 107. Thus, the first sealing member 106 and the second sealing member 107, which are disposed in the support hole 52 of the bearing housing 50, are cooled. This prevents the temperatures of the first sealing member 106 and the second sealing member 107 from being excessively high, thereby preventing the first sealing member 106 and the second sealing member 107 from being degraded.

(3) Regarding Advantages Related to Floating Bearing 120 and Surrounding Structure (3-1) As shown in FIG. 7, the stopper portion 85 of the connecting shaft 80 is opposed to the exhaust-side end face 125 of the floating bearing 120. When the stopper portion 85 of the connecting shaft 80 and the end face 125 of the floating bearing 120 contact each other while the connecting shaft 80 is rotating, the stopper portion 85 and the end face 125 of the floating bearing 120 may be worn.

In the present embodiment, some of the oil supplied to the space between the outer circumferential surface of the connecting shaft 80 and the inner circumferential surface of the floating bearing 120 flows to the space between the stopper portion 85 of the connecting shaft 80 and the end face 125 of the floating bearing 120. Thus, when the connecting shaft 80 is rotating, the oil between the end face 125 of the floating bearing 120 and the stopper portion 85 of the connecting shaft 80 is dragged by the rotation of the stopper portion 85 of the connecting shaft 80 and flows in the rotation direction of the connecting shaft 80.

Each of the tapered surfaces 125*b* on the end face 125 of the floating bearing 120 is inclined to approach the stopper portion 85 in the rotation axis direction toward the first side in the circumferential direction of the connecting shaft 80. That is, the distance between each tapered surface 125*b* of the floating bearing 120 and the stopper portion 85 of the connecting shaft 80 decreases toward the leading side in the rotation direction of the connecting shaft 80. Thus, when the oil flows by being dragged by rotation of the stopper portion 85 of the connecting shaft 80, the oil attempts to flow into this narrow section, increasing the pressure in the narrow section. The pressure of the oil between each tapered surface 125*b* of the floating bearing 120 and the stopper portion 85 of the connecting shaft 80 is thus increased, so that a sufficient clearance between the end face 125 of the floating bearing 120 and the stopper portion 85 of the connecting shaft 80 is ensured. As a result, the end face 125 of the floating bearing 120 and the stopper portion 85 of the connecting shaft 80 are prevented from being worn by contacting each other.

(3-2) The end face 125 of the floating bearing 120 include the four land surfaces 125*a* and the four tapered surfaces 125*b*, which are spaced apart in the circumferential direction of the connecting shaft 80. Accordingly, four sections equally spaced apart in the circumferential direction are created, in each of which the pressure of the oil between the tapered surface 125*b* of the floating bearing 120 and the stopper portion 85 of the connecting shaft 80 is increased. This prevents the connecting shaft 80 from being inclined relative to the floating bearing 120 by the pressure of the oil acting on the stopper portion 85 of the connecting shaft 80.

(3-3) The grooves 125*c* on the end face 125 of the floating hearing 120 extend outward in the radial direction of the connecting shaft 80 from the inner periphery 125*d* of the end face 125. This allows the oil between the outer circumferential surface of the connecting shaft 80 and the inner circumferential surface of the floating bearing 120 to be supplied to the space between the tapered surfaces 125*b* of the floating bearing 120 and the stopper portion 85 of the connecting shaft 80 via the grooves 125*c*. Accordingly, the amount of oil supplied to the space between the tapered surfaces 125*b* of the floating bearing 120 and the stopper portion 85 of the connecting shaft 80 via the grooves 125*c* is prevented from being insufficient.

(3-4) The grooves 125*c* on the end face 125 of the floating bearing 120 do not reach the outer periphery 125*e* of the end face 125. Thus, the oil that has flowed into the grooves 125*c* of the floating bearing 120 is unlikely to flow further outward in the radial direction than the outer periphery 125*e* of the end face 125 via the grooves 125*c*. This prevents reduction in the amount oil supplied to the space between the tapered surfaces 125*b* of the floating bearing 120 and the stopper portion 85 of the connecting shaft 80 via the grooves 125*c*.

(3-5) Each of the grooves 125*c* on the end face 125 of the floating bearing 120 is located at the edge of the tapered surface 125*b* on a second side in the circumferential direction (the counterclockwise side in FIG. 10B). The second side refers to the side opposite to the leading side in the rotation direction of the connecting shaft 80. That is, the grooves 125*c* are located at sections where the pressure of the oil between the tapered surfaces 125*b* of the floating bearing 120 and the stopper portion 85 of the connecting shaft 80 is relatively low. Thus, in the present embodiment, the oil that has flowed into each groove 125*c* more readily flows to the space between the tapered surfaces 125*b* of the floating bearing 120 and the stopper portion 85 of the connecting shaft 80 than in a case in which each groove 125*c* is located at the end of the tapered surface 125*b* on the first side in the circumferential direction of the connecting shaft 80 (the clockwise side in FIG. 10B).

(3-6) In the present embodiment, the end face 128 on the intake side of the floating bearing 120 has the same structure as the end face 125 on the exhaust side of the floating bearing 120. Also, the end face 128 of the floating bearing 120 is opposed to the stopper annular portion 112 of the stopper bushing 110 on the connecting shaft 80. The stopper bushing 110 rotates integrally with the shaft body 81. Thus, when the connecting shaft 80 is rotating, the oil between the end face 128 of the floating bearing 120 and the stopper annular portion 112 of the stopper bushing 110 is dragged by the rotation of the stopper annular portion 112 of the stopper bushing 110 and flows in the rotation direction of the connecting shaft 80. This ensures a clearance between the end face 128 of the floating bearing 120 and the stopper annular portion 112 of the stopper bushing 110 on the connecting shaft 80.

(3-7) The fixing pin 129 inserted into the fixing hole 122 of the floating bearing 120 fixes the floating bearing 120 against rotation and movement in the rotation axis direction relative to the bearing housing 50. Thus, there is no need to provide, on the end face 128 on the intake side of the floating bearing 120, a structure for fixing the floating bearing 120 relative to the bearing housing 50. Therefore, the same configuration as that of the end face 125 on the exhaust side of the floating bearing 120 is employed for the end face 128 on the intake side of the floating bearing 120.

(3-8) As described above, there is no need to provide, on the end face 128 on the intake side of the floating bearing 120, a structure for fixing the floating bearing 120 relative to the bearing housing 50. Thus, no thrust bearing or the like for supporting the end face 128 of the floating bearing 120 needs to be provided at a portion on the intake side of the main body 51 of the bearing housing 50. Accordingly, no structure for installing a thrust bearing needs to be provided in the portion on the intake side of the main body 51 of the bearing housing 50, which increases the flexibility in design of the portion on the intake side of the main body 51 of the bearing housing 50. In the present embodiment, the intake-side end space 54*a* of the oil discharge space 54 is provided in the portion on the intake side of the main body 51 of the bearing housing 50. The intake-side end space 54*a* has an annular shape as a whole. This allows the oil in the intake-side end space 54*a* to be readily discharged to the outside of the bearing housing 50 from the oil discharge port 55 through the center space 54*b*.

(3-9) The exhaust-side annular space 54*e* of the oil discharge space 54 of the bearing housing 50 is defined to encompass the end on the exhaust side of the floating bearing 120 from the radially outer side. The exhaust-side annular space 54*e* of the oil discharge space 54 is connected to the space between the end face 125 of the floating bearing 120 and the stopper portion 85 of the connecting shaft 80. Thus, the oil supplied to the space between the end face 125 of the floating bearing 120 and the stopper portion 85 of the connecting shaft 80 flows outward in the radial direction of the connecting shaft 80 and reaches the exhaust-side annular space 54*e* of the oil discharge space 54. Thus, the oil is discharged to the outside of the bearing housing 50 via the oil discharge space 54 and the oil discharge port 55. This prevents oil from being stagnant between the end face 125 of the floating bearing 120 and the stopper portion 85 of the connecting shaft 80. As a result, the flow of oil between the end face 125 of the floating bearing 120 and the stopper portion 85 of the connecting shaft 80 is not hindered by stagnant oil. The intake-side annular space 54*d* of the oil discharge space 54 prevents oil from being stagnant between the end face 128 of the floating bearing 120 and the stopper annular portion 112 of the stopper bushing 110 on the connecting shaft 80.

(3-10) In some cases, an excessive amount of oil flows to the intake-side annular space 54*d* of the oil discharge space 54 from the space between the end face 128 of the floating bearing 120 and the stopper annular portion 112 of the stopper bushing 110 on the connecting shaft 80. If the amount of oil flowing into the intake-side annular space 54*d* is excessive, the pressure of oil in the intake-side annular space 54*d* may become high. In such a case, the oil in the intake-side annular space 54*d* may flow to the intake side via the space between the inner circumferential surface of the intake-side support hole 52*b* of the support hole 52 of the bearing housing 50 and the outer circumferential surface of the stopper annular portion 112 of the stopper bushing 110 on the connecting shaft 80. Since the pressure of oil that flows toward the intake side is high, oil may flow into the accommodation space 32 of the compressor housing 30 through the space between the inner circumferential surface of the insertion hole 41 of the seal plate 40 and the outer circumferential surface of the bushing body 111 of the stopper bushing 110 on the connecting shaft 80.

In the present embodiment, the annular groove 114, which is a substantially annular space, is defined between the annular portion 113 and the stopper annular portion 112 of the stopper bushing 110. Thus, the oil that has flowed toward the intake side through the space between the inner circumferential surface of the intake-side support hole 52*b* of the support hole 52 of the bearing housing 50 and the outer circumferential surface of the stopper annular portion 112 of the stopper bushing 110 on the connecting shaft 80 is introduced into the annular groove 114 of the stopper bushing 110. When the oil is introduced into the annular groove 114 of the stopper bushing 110, the pressure of the oil that has flowed to the intake side is lowered. This limits entry of oil into the accommodation space 32 of the compressor housing 30 through the space between the inner circumferential surface of the insertion hole 41 of the seal plate 40 and the outer circumferential surface of the bushing body 111 of the stopper bushing 110 on the connecting shaft 80.

(4) Regarding Advantages Related to Seal Plate 40 and Surrounding Structure (4-1) If the bearing housing 50 does not include the support portions 58, the main body 51 of the bearing housing 50 contacts the central portion of the seal plate 40 in the rotation axis direction. In this configuration, for example, when vibrations of the internal combustion engine 10 apply force in the rotation axis direction to the radially outer portion of the seal plate 40, the seal plate 40 may be deformed in a warping manner. Such deformation of the seal plate 40 hinders the sealing property between the end face 40*a* of the seal plate 40 and the exhaust-side end face of the compressor housing 30, so that intake air may leak through the space between the end face 40*a* of the seal plate 40 and the exhaust-side end face of the compressor housing 30.

As shown in FIG. 5, in the present embodiment, the support portions 58 protrude from the end on the intake side of the outer circumferential surface of the main body 51 of the bearing housing 50. The support portions 58 protrude outward in the radial direction of the connecting shaft 80. The seal plate 40 contacts the support portions 58 of the bearing housing 50 from the intake side. Thus, even if the radially outer portion of the seal plate 40 that is located radially outward of the main body 51 of the bearing housing 50 attempts to be deformed from the intake side toward the exhaust side, the deformation of the seal plate 40 is limited by the support portions 58 of the bearing housing 50. This limits deformation of the seal plate 40 even if a force from the intake side toward the exhaust side acts on the radially outer portion of the seal plate 40.

(4-2) The support portions 58 of the bearing housing 50 are fixed to the seal plate 40 with the bolts 192. Since the seal plate 40 is fixed to the support portions 58, the support portions 58 of the bearing housing 50 limit deformation of the seal plate 40 even if the radially outer portion of the seal plate 40 attempts to be deformed from the exhaust side toward the intake side. This limits deformation of the seal plate 40 to either side in the rotation axis direction even if a force in the rotation axis direction acts on the radially outer portion of the seal plate 40.

(4-3) As shown in FIG. 9, the three support portions 58 are spaced apart from each other in the circumferential direction of the connecting shaft 80. Thus, the present embodiment limits deformation of the seal plate 40 while minimizing the increase in weight due to the existence of the support portions 58, as compared to a configuration in which a support portion 58 extends over the entire area in the circumferential direction of the connecting shaft 80.

(4-4) Since the support portions 58 are spaced apart from each other in the circumferential direction of the connecting shaft 80, the outer diameter of the portion of the bearing housing 50 where the support portions 58 are not provided is small. A configuration is assumed in which the bearing housing 50 is formed by casting, and cavities for a plurality of bearing housings 50 are formed in a single mold. In this case, the number of the bearing housings 50 that can be cast in the single mold is easily increased by forming the cavities such that the support portions 58 of the bearing housings 50 are arranged in a staggered manner.

(4-5) The first support portion 58*a* is located on the first side in the direction along the imaginary straight line 58*d* with respect to the rotation axis 80*a* of the connecting shaft 80. Also, the second support portion 58*b* is located on the second side in the direction along the imaginary straight line 58*d* with respect to the rotation axis 80*a* of the connecting shaft 80. That is, in the direction along the imaginary straight line 58*d*, the first support portion 58*a* and the second support portion 58*b* are located on the opposite sides of the rotation axis 80*a* of the connecting shaft 80. Thus, the radially outer portion of the seal plate 40 contacts the first support portion 58*a* and the second support portion 58*b*, which are located on the opposite sides of the rotation axis 80*a* of the connecting shaft 80. This limits deformation in the rotation axis direction of the radially outer portion of the seal plate 40 in the circumferential direction of the connecting shaft 80. Likewise, in the direction along the imaginary straight line 58*d*, the first support portion 58*a* and the third support portion 58*c* are located on the opposite sides of the rotation axis 80*a* of the connecting shaft 80. Thus, deformation in the rotation axis direction of the radially outer portion of the seal plate 40 is limited by contacting the first support portion 58*a* and the third support portion 58*c*, which are located on the opposite sides of the rotation axis 80*a* of the connecting shaft 80.

(5) Regarding Advantages Related to Heat Shield Plate 130 and Surrounding Structure (5-1) In the turbocharger 20, exhaust gas is introduced into the turbine housing 60, which increases the temperature of the turbine housing 60. If the opposed surface 68*a* of the clamping flange 68 of the turbine housing 60 is contacting the opposed surface 59*a* of the clamping flange 59 of the bearing housing 50, the temperature of the portion on the intake side of the tubular portion 60B is lowered since heat is transferred from this portion to the bearing housing 50. In contrast, since heat of the portion on the exhaust side of the tubular portion 60B of the turbine housing 60 is less prone to being transferred to the bearing housing 50, so that the temperature is not lowered easily. That is, the temperature of the portion on the intake side of the tubular portion 60B of the turbine housing 60 is relatively low, while the temperature of the portion on the exhaust side of the tubular portion 60B of the turbine housing 60 is relatively high. When there is such a difference in temperature in the turbine housing 60, differences in the amounts of thermal expansion is likely to generate a great internal stress in the turbine housing 60, which may cause deformation or cracking of the turbine housing 60.

In the present embodiment, a clearance exists over the entire area in which the opposed surface 59*a* of the clamping flange 59 of the bearing housing 50 and the opposed surface 68*a* of the clamping flange 68 of the turbine housing 60 are opposed to each other in the rotation axis direction. In a section where such a clearance exists, heat is less prone to being transferred from the clamping flange 68 of the turbine housing 60 to the clamping flange 59 of the bearing housing 50. Thus, the temperature of the portion on the intake side of the tubular portion 60B of the turbine housing 60 is not lowered easily. Accordingly, the turbine housing 60 is unlikely to have portions of high temperatures and portions of low temperatures. As a result, internal stress due to differences in the amounts of thermal expansion is less prone to being generated in the turbine housing 60. This suppresses the occurrence of deformation and cracking.

(5-2) In the thickness direction of the outer peripheral portion 133 of the heat shield plate 130, the outer peripheral portion 133 is clamped between the clamping surface 51*d* of the connecting portion 51*a* of the bearing housing 50 and the clamping surface 67*d* of the connecting hole 67 of the turbine housing 60. Since the outer peripheral portion 133 of the heat shield plate 130 has the shape of a flat plate, the outer peripheral portion 133 resists deformation in the thickness direction. Thus, the positional relationship between the bearing housing 50 and the turbine housing 60 in the rotation axis direction is determined by using the outer peripheral portion 133 of the heat shield plate 130. Therefore, displacement of the positional relationship between the bearing housing 50 and the turbine housing 60 in the rotation axis direction is limited even if there is a clearance between the opposed surface 59*a* of the clamping flange 59 of the bearing housing 50 and the opposed surface 68*a* of the clamping flange 68 of the turbine housing 60, so that the opposed surfaces 59*a* and 68*a* are not contacting each other.

(5-3) Over the entire area in the circumferential direction of the connecting shaft 80, the outer peripheral portion 133 of the heat shield plate 130 is clamped between the clamping surface 51*d* of the connecting portion 51*a* of the bearing housing 50 and the clamping surface 67*d* of the connecting hole 67 of the turbine housing 60. Thus, over the entire area in the circumferential direction of the connecting shaft 80, the outer peripheral portion 133 of the heat shield plate 130 closely contact the clamping surface 51*d* of the connecting portion 51*a* of the bearing housing 50 and the clamping surface 67*d* of the connecting hole 67 of the turbine housing 60. This allows the outer peripheral portion 133 of the heat shield plate 130 to function as a sealing member that limits leakage of exhaust gas to the outside from the inside of the turbine housing 60. Therefore, even if there is a clearance between the opposed surface 59*a* of the clamping flange 59 of the bearing housing 50 and the opposed surface 68*a* of the clamping flange 68 of the turbine housing 60, exhaust gas will not leak to the outside through the clearance. As a result, there is no need to provide a sealing member for limiting leakage of exhaust gas to the outside from the inside of the turbine housing 60.

(5-4) As described above, the outer peripheral portion 133 of the heat shield plate 130 is clamped between the clamping surface 51*d* of the connecting portion 51*a* of the bearing housing 50 and the clamping surface 67*d* of the connecting hole 67 of the turbine housing 60. Thus, the outer peripheral portion 133 of the heat shield plate 130 does not move in a direction orthogonal to the rotation axis 80*a* of the connecting shaft 80. This prevents the outer peripheral portion 133 of the heat shield plate 130 from sliding on the clamping surface 51*d* of the connecting portion 51*a* of the bearing housing 50 or the clamping surface 67*d* of the connecting hole 67 of the turbine housing 60. The outer peripheral portion 133 of the heat shield plate 130 is therefore not worn.

(6) Advantages Related to Wastegate 150 and Surrounding Structure (6-1) It is assumed that the shaft 151 and the valve member 152 of the wastegate 150 are separate components, and these are assembled together to form the wastegate 150. In this configuration, chattering noise may occur at the part where the shaft 151 and the valve member 152 are assembled when the wastegate 150 switches the bypass passages 64 from the open state to the fully closed state or when the pressure of exhaust gas flowing through the bypass passages 64 fluctuates when the wastegate 150 is holding the bypass passages 64 in the open state. Such chattering noise may be perceived as unusual noise by occupants of the vehicle.

In the present embodiment, the wastegate 150 is an integrally molded member in which the shaft 151 and the valve member 152 are integrated as shown in FIG. 12B. Since the shaft 151 and the valve member 152 are integrated, the valve member 152 does not swing relative to the shaft 151, so that chattering noise due to swinging is not generated.

(6-2) It is now assumed that the distance A shown in FIG. 12C, which is the distance from the contact surface 154*a* of the valve member 152 to the rotation axis 151*a* of the shaft 151 in a direction orthogonal to the contact surface 154*a* of the valve member 152, is designed to be equal to the distance B shown in FIG. 13, which is the distance from the contact surface 65*a* of the valve seat 65 to the rotation axis 151*a* of the shaft 151 in a direction orthogonal to the contact surface 65*a* of the valve seat 65. If the wastegate 150 and the turbine housing 60 are manufactured as designed, the contact surface 65*a* of the valve seat 65 of the turbine housing 60 and the contact surface 154*a* of the valve member 152 of the wastegate 150 are in surface contact with each other when the bypass passages 64 are in the fully closed state.

Figure 15A:
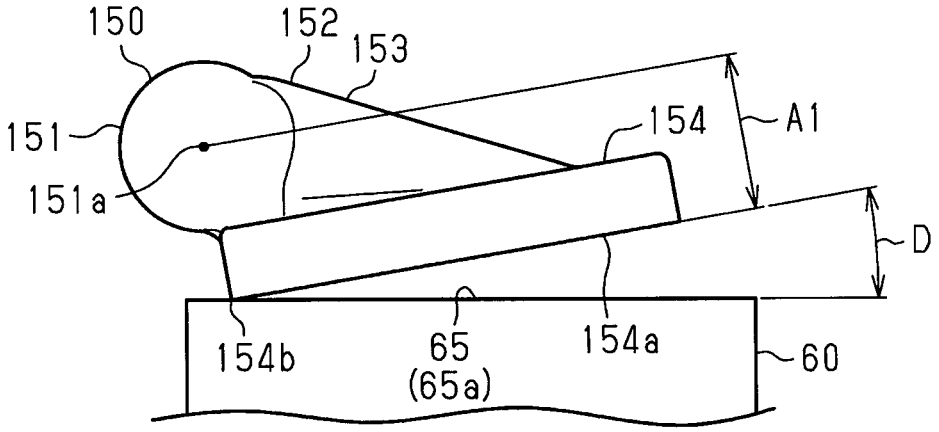
FIG. 15A is a diagram illustrating a wastegate of a comparative example and its surrounding structure.

However, even if the contact surface 65*a* of the valve seat 65 of the turbine housing 60 and the contact surface 154*a* of the valve member 152 of the wastegate 150 are designed to be in surface contact with each other in the fully closed state of the bypass passages 64 as described above, surface contact may fail to be achieved in reality due to manufacturing errors or the like. In particular, when the actual distance A1 is longer than the designed distance A, the wastegate 150 contacts the contact surface 65*a* of the valve seat 65 from the tail as shown in FIG. 15A when the bypass passages 64 are switched to the fully closed state. Specifically, when the bypass passages 64 are switched to the fully closed state, a first end 154*b* of the contact surface 154*a* that is on the side closer to the shaft 151 interferes with the contact surface 65*a* of the valve seat 65 before the wastegate 150 is fully closed, and the wastegate 150 cannot rotate further.

Figure 15B:
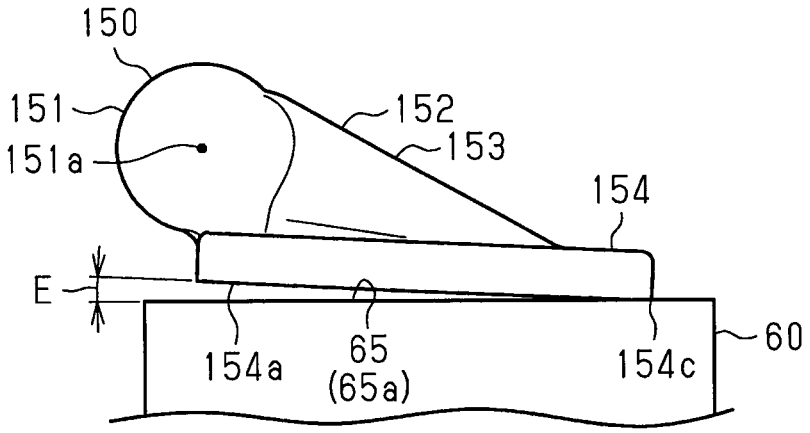
FIG. 15B is a diagram illustrating the wastegate of the embodiment and its surrounding structure.

In the present embodiment, the distance A is designed to be shorter than the distance B. Therefore, even if there are some manufacturing errors in the wastegate 150 or the turbine housing 60, the wastegate 150 contacts the contact surface 65*a* of the valve seat 65 from the head as shown in FIG. 15B when the bypass passages 64 are switched to the fully closed state. Specifically, when the bypass passages 64 are switched to the fully closed state, a second end 154*c* of the contact surface 154*a* that is on the side further from the shaft 151 (the right side in FIG. 15B) contacts the contact surface 65*a* of the valve seat 65. Thus, the contact surface 154*a* of the valve member 152 will not contact the contact surface 65*a* of the valve seat 65 before the wastegate 150 is fully closed. Accordingly, even if the same amount of manufacturing errors are present, in the fully closed state of the bypass passages 64, the angle E defined by the contact surface 154*a* of the valve member 152 and the contact surface 65*a* of the valve seat 65 is smaller than the angle D defined by the contact surface 154*a* of the valve member 152 and the contact surface 65*a* of the valve seat 65 as shown in FIGS. 15A and 15B. As a result, in the fully closed state of the bypass passages 64, the clearance between the contact surface 154*a* of the valve member 152 and the contact surface 65*a* of the valve seat 65 is reduced, thereby reducing the amount of exhaust gas leaking from the bypass passages 64 to the discharge passage 63. In FIGS. 15A and 15B, the angle D and the angle E are exaggerated.

(6-3) When the bypass passages 64 are switched to the fully closed state, the link rod 172 is moved from the second side in the longitudinal direction of the link rod 172 (the upper side in FIG. 13) toward the first side (the lower side in FIG. 13) by the operation of the actuator 180 as shown FIG. 13. When the bypass passages 64 are maintained in the fully closed state, the end of the shaft 151 of the wastegate 150 that is outside the turbine housing 60 receives a force that acts from the second side toward the first side in the longitudinal direction of the link rod 172 via the link arm 171. This inclines the shaft 151 of the wastegate 150 such that the end outside the turbine housing 60 is located on the first side in the longitudinal direction of the link rod 172, and the end in the turbine housing 60 is located on the second side in the longitudinal direction of the link rod 172. Also, the contact surface 154*a* of the valve member 152 of the wastegate 150 is inclined such that the end outside the turbine housing 60 is located on the first side in the longitudinal direction of the link rod 172, and the end in the turbine housing 60 is located on the second side in the longitudinal direction of the link rod 172.

In the present embodiment, the contact surface 154*a* of the valve member 152 is inclined relative to the rotation axis 151*a* of the shaft 151 as shown in FIG. 12A in expectation of the inclination of the shaft 151 of the wastegate 150, which is caused when the bypass passages 64 are in the fully closed state. Specifically, the contact surface 154*a* of the valve member 152 is inclined to shift outward in the radial direction of the shaft 151 as the distance from the link arm 171 increases in the rotation axis direction of the shaft 151. As shown in FIG. 13, the contact surface 154*a* of the valve member 152 and the contact surface 65*a* of the valve seat 65 are parallel with each other in the fully closed state of the bypass passages 64. Accordingly, even if the shaft 151 is inclined in the fully closed state of the bypass passages 64, the clearance between the contact surface 154*a* of the valve member 152 and the contact surface 65*a* of the valve seat 65 is reduced.

(6-4) When the bypass passages 64 are switched to the fully closed state, the wastegate 150 rotates about the rotation axis 151*a* of the shaft 151, so that the second end 154*c* of the contact surface 154*a* of the valve member 152, which is farther from the shaft 151, contacts the contact surface 65*a* of the valve seat 65 as shown in FIG. 15B. When the second end 154*c* of the contact surface 154*a* of the valve member 152 is contacting the contact surface 65*a* of the valve seat 65, a part of the valve member 152 that is closer to the shaft 151 receives a greater stress generated by the valve member 152 pressing the valve seat 65. The dimension of the connection portion 153 in a direction orthogonal to the contact surface 154*a* of the valve main body 154 increases toward the shaft 151 (toward the left side in the FIG. 15B). Thus, in the wastegate 150, the stiffness of the connection portion 153 of the valve member 152 is increased. This suppresses the occurrence of deformation and cracking of the connection portion 153 of the valve member 152.

(7) Regarding Advantages Related to Bypass Passage 64 and Surrounding Structure (7-1) As shown in FIG. 8, when exhaust gas flows through the bypass passages 64 when the bypass passages 64 are open in the turbocharger 20, the exhaust gas flows toward the catalyst 15, which is located on the downstream side of the turbine housing 60. The exhaust gas heats the catalyst 15 to activate the catalyst 15, so that the catalyst 15 exerts the purifying performance.

Even if the flow rate and the temperature of the exhaust gas flowing toward the catalyst 15 are the same, the rate at which the catalyst 15 is heated varies depending on the angle defined by the partition walls 17 of the catalyst 15 and the flowing direction of the exhaust gas. For example, in some cases, if the acute angle C, which is defined by the central axes 64*b* of the outlet portions 64*a* of the bypass passages 64 and the central axis 16*a* of the tubular portion 16 of the catalyst 15, is large (for example, 80 degrees), the exhaust gas that has flowed through the bypass passages 64 strikes the upstream end of the catalyst 15, so that the exhaust gas stagnates in the section of the exhaust line 13 that is on the upstream side of the catalyst 15. Also, in some cases, if the central axes 64*b* of the outlet portions 64*a* of the bypass passages 64 and the central axis 16*a* of the tubular portion 16 of the catalyst 15 are parallel with each other, the exhaust gas that has flowed through the bypass passages 64 flows toward the downstream side without striking the wall surfaces of the partition walls 17 of the catalyst 15. That is, the heating rate of the catalyst 15 will be lowered and the catalyst 15 cannot be readily activated if the acute angle C, which is defined by the central axes 64*b* of the outlet portions 64*a* of the bypass passages 64 and the central axis 16*a* of the tubular portion 16 of the catalyst 15, is too large or too small.

In the present embodiment, the central axes 64*b* of the outlet portions 64*a* of the bypass passages 64 intersect with the first partition walls 17*a* of the catalyst 15. The acute angle C, which is defined by the central axes 64*b* of the outlet portions 64*a* of the bypass passages 64 and the central axis 16*a* of the tubular portion 16 of the catalyst 15, is 30 degrees. Thus, when the bypass passages 64 are in the open state and the exhaust gas that has flowed through the bypass passages 64 reaches the catalyst 15, the exhaust gas strikes the wall surfaces of the first partition walls 17*a* of the catalyst 15. The exhaust gas that has stricken the wall surfaces of the first partition walls 17*a* flows toward the downstream side along the wall surfaces of the first partition walls 17*a*. Accordingly, the heat of the exhaust gas is transferred to the first partition walls 17*a*, so that the temperature of the catalyst 15 is increased quickly.

(7-2) As shown in FIG. 8, the contact surface 154*a* of the valve member 152 of the wastegate 150 is a flat surface as a whole including the part that contacts the valve seat 65. Thus, in the present embodiment, when the bypass passages 64 are in the open state, the flow of the exhaust gas that has flowed through the bypass passages 64 is not hindered by the valve member 152 of the wastegate 150, as compared to a case in which the contact surface 154*a* of the valve member 152 is partially curved. This guides the exhaust gas that has flowed through the bypass passages 64 toward the catalyst 15 by the valve member 152 of the wastegate 150.

(8) Regarding Advantages Related to Method for Welding Turbine Wheel 90 and Connecting Shaft 80

(8-1) In the above-described welding process, the production welding is performed on the contacting portions of the end on the intake side of the shaft portion 92 of the turbine wheel 90 and the end on the exhaust side of the large diameter portion 82 of the connecting shaft 80, while rotating the contacting portions one turn about the rotation axis 80*a* of the connecting shaft 80. Thus, the weld time of the present embodiment is shorter than that of a manufacturing method in which the turbine wheel 90 and the connecting shaft 80 are rotated two or more turns about the rotation axis 80*a* of the connecting shaft 80. This limits an increase in the manufacturing costs of the turbocharger 20 due to an elongated weld time of the turbine wheel 90 and the connecting shaft 80.

The present embodiment may be modified as follows. The present embodiment and the following modifications can be combined as long as the combined modifications remain technically consistent with each other.

<Modifications to Compressor Housing 30 and Surrounding Structure>

In the above-described embodiment, the number of the guide vanes 37 can be changed. For example, if the number of the blades 71 of the compressor wheel 70 is changed, the number of the guide vanes 37 can be changed to the smallest odd number that is greater than the number of the blades 71.

For example, if the vibration generated by the compressor wheel 70 is relatively small and does not cause any problems to the operation of the turbocharger 20, the number of the guide vanes 37 may be changed regardless of the number of the blades 71.

In the above-described embodiment, the configuration of the compressor wheel 70 can be changed. For example, the number of the blades 71 may be changed as described above. Likewise, the number of the auxiliary blades 72 may be changed, and the auxiliary blades 72 may be omitted. Also, the relationship between the number of the blades 71 and the number of the auxiliary blades 72 can be changed. Specifically, the number of the blades 71 may be greater than or less than the number of the auxiliary blades 72.

In the above-described embodiment, the configuration of the compressor housing 30 can be changed. For example, the length of the guide vanes 37 in the rotation axis direction can be changed. Specifically, the guide vanes 37 may be provided only on the intake side of the midpoint X in the tubular member 36. Alternatively, the guide vanes 37 may be provided only on the exhaust side of the midpoint X in the tubular member 36.

In the above-described embodiment, the inlet duct 36A and the housing body 39 in the compressor housing 30 may be formed integrally. In this case also, the guide vanes 37 are simply required to protrude from the inner wall surface of the introduction passage 35 in the compressor housing 30.

In the above-described embodiment, the inlet duct 36A and the intake line 11 may be separate components.

<Modifications to Connecting Shaft 80 and Surrounding Structure>

In the above-described embodiment, the configuration of the connecting shaft 80 can be changed. For example, if the exhaust gas in the turbine housing 60 is unlikely to flow into the bearing housing 50, the second sealing member 107 may be omitted. Accordingly, the second recess 82*b* of the connecting shaft 80 may be omitted.

In the above-described embodiment, the orientation of the second sealing member 107 relative to the first sealing member 106 can be changed. For example, in a case in which a relatively small amount of exhaust gas flows to the intake side of the first sealing member 106 from the inside of the turbine housing 60, the slit of the second sealing member 107 and the slit of the first sealing member 106 may be located at the same position in the circumferential direction when viewed in the rotation axis direction. That is, when viewed in the rotation axis direction, there may be a section at which neither the first sealing member 106 nor the second sealing member 107 exists.

In the above-described embodiment, the configuration of the first sealing member 106 and the second sealing member 107 can be changed. For example, the first sealing member 106 may have an annular shape without a slit. In this ease, the orientation of the second sealing member 107 relative to the first sealing member 106 can be changed as appropriate. The range of extension of the first sealing member 106 in the circumferential direction of the connecting shaft 80 may be less than 180 degrees. In this case, if the sum of the range of extension of the first sealing member 106 and the range of extension of the second sealing member 107 exceeds 360 degrees, the first sealing member 106 and the second sealing member 107 can be arranged such that, when viewed in the rotation axis direction, either the first sealing member 106 or the second sealing member 107 exists at any position.

In the above-described embodiment, the shape of the coolant passage 56 of the bearing housing 50 can be changed. For example, if the temperature of the first sealing member 106, Which is increased by the heat of exhaust gas flowing in from the inside of the turbine housing 60, is relatively low, the end on the exhaust side of the coolant passage 56 may be located on the intake side of the second sealing member 107.

<Modifications to Floating Bearing 120 and Surrounding Structure>

In the above-described embodiment, the configuration of the floating bearing 120 can be changed. For example, the tapered surfaces 125*b* on the end face 125 of the floating bearing 120 may be omitted if the amount oil flowing between the stopper portion 85 of the connecting shaft 80 and the end face 125 of the floating bearing 120 is great, and the stopper portion 85 of the connecting shaft 80 and the end face 125 of the floating bearing 120 are unlikely to contact each other.

In the above-described embodiment, the number of the land surface 125*a* and the number of the tapered surface 125*b* on the end face 125 of the floating bearing 120 may be changed. For example, the number of the land surfaces 125*a* and the number of the tapered surfaces 125*b* may be less than or greater than four.

In the above-described embodiment, the positions of the grooves 125*c* on the tapered surfaces 125*b* of the floating bearing 120 can be changed. For example, each groove 125*c* may be located at the center in the circumferential direction of the tapered surface 125*b* or the end of the tapered surface 125*b* on the leading side in the rotation direction of the connecting shaft 80.

In the above-described embodiment, the shape of the grooves 125*c* on the tapered surfaces 125*b* of the floating bearing 120 can be changed. For example, the outer end of each groove 125*c* in the radial direction of the connecting shaft 80 may reach the outer periphery 125*e* of the end face 125. The depth of the groove 125*c* may be uniform.

In the above-described embodiment, the grooves 125*c* on the tapered surfaces 125*b* of the floating bearing 120 may be omitted. For example, the grooves 125*c* may be omitted in a case in which a sufficient amount of oil is supplied to the tapered surfaces 125*b* of the floating bearing 120 from the space between the outer circumferential surface of the connecting shaft 80 and the inner circumferential surface of the floating bearing 120.

In the above-described embodiment, the configuration of the bearing housing 50 can be changed. For example, the exhaust-side annular space 54*e* of the oil discharge space 54 of the bearing housing 50 may be omitted in a case in which a small amount of oil that flows outward in the radial direction from the space between the stopper portion 85 of the connecting shaft 80 and the end face 125 of the floating bearing 120. Likewise, the intake-side annular space 54*d* of the oil discharge space 54 of the bearing housing 50 may be omitted.

In the above-described embodiment, the fixing pin 129 for fixing the floating bearing 120 may be omitted. For example, the fixing pin 129 may be omitted if a recess is formed in the end on the intake side of the floating bearing 120, and the floating bearing 120 is fixed to the bearing housing 50 by fitting a protruding member into the recess. In such a case, if a configuration similar to that of the end face 125 on the exhaust side of the floating bearing 120 cannot be used in the end face 128 on the intake side of the floating bearing 120, a thrust bearing or the like may be attached to the bearing housing 50 to support the end face 128 of the floating bearing 120.

<Modification to Seal Plate 40 and Surrounding Structure>

In the above-described embodiment, the configuration of the bearing housing 50 can be changed. For example, the support portions 58 of the bearing housing 50 may be omitted if the amount of deformation in the radially outer portion of the seal plate 40 generated by vibrations of the internal combustion engine 10 is small.

In the above-described embodiment, the configuration by which the support portions 58 of the bearing housing 50 are fixed to the seal plate 40 may be changed. For example, the support portions 58 of the bearing housing 50 may be fixed to the radially outer portion of the seal plate 40 by welding.

Also, the support portions 58 of the bearing housing 50 do not necessarily need to be fixed to the seal plate 40. For example, if the main body 51 of the bearing housing 50 is fixed to the central portion of the seal plate 40, the support portions 58 of the bearing housing 50 do not need to be fixed to the seal plate 40.

In the above-described embodiment, the shape and the number of the support portions 58 of the bearing housing 50 can be changed. For example, the number of the support portions 58 of the bearing housing 50 may be one or greater than three. Alternatively, the bearing housing 50 may be provided with one support portion 58 that extends over the entire area in the circumferential direction of the connecting shaft 80.

In the above-described embodiment, the positional relationship of the support portions 58 of the bearing housing 50 can be changed. For example, the first support portion 58*a*, the second support portion 58*b*, and the third support portion 58*c* may all be located on the first side in a direction along the imaginary straight line 58*d* with respect to the rotation axis 80*a* of the connecting shaft 80. If the radially outer portion of the seal plate 40 has a section that is likely to be warped in the rotation axis direction, a support portion 58 is preferably provided in the vicinity of that section.

<Modification to Heat Shield Plate 130 and Surrounding Structure>

In the above-described embodiment, the configuration for fixing the heat shield plate 130 between the bearing housing 50 and the turbine housing 60 can be changed. For example, the outer peripheral portion 133 of the heat shield plate 130 may be partially clamped between the bearing housing 50 and the turbine housing 60 in a section in the circumferential direction of the connecting shaft 80. In this case, an additional sealing member is provided, for example, between the bearing housing 50 and the turbine housing 60, so as to limit leakage of the exhaust gas to the outside from the inside of the turbine housing 60.

For example, in a case in which the displacement in the rotation axis direction between the bearing housing 50 and the turbine housing 60 is relatively small, the outer peripheral portion 133 of the heat shield plate 130 does not need to be clamped between the bearing housing 50 and the turbine housing 60 in the thickness direction of the outer peripheral portion 133.

In the above-described embodiment, the configuration for fixing the clamping flange 68 of the turbine housing 60 and the clamping flange 59 of the bearing housing 50 to each other can be changed. For example, the clamping flange 68 of the turbine housing 60 and the clamping flange 59 of the bearing housing 50 may be fixed to each other with bolts and nuts.

In the above-described embodiment, the shapes of the clamping flange 68 of the turbine housing 60 and the clamping flange 59 of the bearing housing 50 can be changed. For example, a recess that is recessed in the rotation axis direction may be provided in the opposed surface 68*a* of the clamping flange 68 of the turbine housing 60. Also, a recess that is recessed in the rotation axis direction may be provided in the opposed surface 59*a* of the clamping flange 59 of the bearing housing 50. Furthermore, a positioning pin may be fitted between the recess of the turbine housing 60 and the recess of the bearing housing 50. In this case also, if a clearance exists between the opposed surface 68*a* of the clamping flange 68 of the turbine housing 60 and the opposed surface 59*a* of the clamping flange 59 of the bearing housing 50, heat is less prone to being transferred from the clamping flange 68 of the turbine housing 60 to the clamping flange 59 of the bearing housing 50.

<Modification to Wastegate 150 and Surrounding Structure>

In the above-described embodiment, the configuration of the wastegate 150 can be changed. For example, the shaft 151 and the valve member 152 of the wastegate 150 may be separate components. In a case in which the chattering noise of the wastegate 150 is relatively low, the noise is unlikely to be perceived as unusual noise by the driver of the vehicle even if the wastegate 150 is constituted by assembling a shaft 151 and a valve member 152 that are separate members.

In the above-described embodiment, the relationship between the distance A from the contact surface 154*a* of the valve member 152 to the rotation axis 151*a* of the shaft 151 in a direction orthogonal to the contact surface 154*a* and the distance B from the contact surface 65*a* of the valve seat 65 to the rotation axis 151*a* of the shaft 151 in a direction orthogonal to the contact surface 65*a* can be changed. For example, if the manufacturing accuracy of the wastegate 150 is high, and the manufacturing errors are negligible, setting the distance A and the distance B to the same value will not cause any problems.

In the above-described embodiment, the inclination of the contact surface 154*a* of the valve member 152 with respect to the rotation axis 151*a* of the shaft 151 may be changed. For example, the amount of inclination of the shaft 151 of the wastegate 150 relative to the through-hole 69 of the turbine housing 60 when the bypass passages 64 are in the fully closed state varies depending on the configurations of the through-hole 69 of the turbine housing 60, the bushing 160, and the shaft 151 of the wastegate 150. Thus, it is only necessary to change the inclination of the contact surface 154*a* of the valve member 152 relative to the rotation axis 151*a* of the shaft 151 in accordance with the amount of inclination of the shaft 151 of the wastegate 150 relative to the through-hole 69 of the turbine housing 60 when the bypass passages 64 are in the fully closed state. When the amount of inclination of the shaft 151 of the wastegate 150 relative to the through-hole 69 of the turbine housing 60 is relatively small, the contact surface 154*a* of the valve member 152 does not necessarily need to be inclined relative to the rotation axis 151*a* of the shaft 151.

For example, when the bypass passages 64 are switched to the fully closed state, the link rod 172 is moved from the first side in the longitudinal direction of the link rod 172 (the lower side in FIG. 13) to the second side (the upper side in FIG. 13) depending on the connecting structure of the link mechanism 170. Then, in the fully closed state of the bypass passages 64, the shaft 151 of the wastegate 150 is inclined such that the end outside the turbine housing 60 is located on the second side in the longitudinal direction of the link rod 172, and the end in the turbine housing 60 is located on the first side in the longitudinal direction of the link rod 172. In this case, the contact surface 154*a* of the valve member 152 simply needs to be inclined to shift radially inward (rightward in FIG. 12A) with respect to the rotation axis 151*a* of the shaft 151 as the distance from the link arm 171 increases in the rotation axis direction of the shaft 151 (toward the lower side in FIG. 12A).

In the above-described embodiment, the configuration of the valve member 152 of the wastegate 150 can be changed. For example, when the contact surface 154*a* of the valve member 152 of the wastegate 150 and the contact surface 65*a* of the valve seat 65 are in surface contact, the stress generated in the valve member 152 when the contact surface 154*a* of the valve member 152 contacts the contact surface 65*a* of the valve s 65 tends to be small. In such a case, the dimension of the connection portion 153 in a direction orthogonal to the contact surface 154*a* of the valve main body 154 may be uniform.

<Modifications to Turbine Housing 60, Catalyst 15 and Surrounding Structure>

In the above-described embodiment, the acute angle C, which is defined by the central axes 64*b* of the outlet portions 64*a* of the bypass passages 64 and the central axis 16*a* of the tubular portion 16 of the catalyst 15, can be changed. For example, the acute angle C, which is defined by the central axes 64*b* of the outlet portions 64*a* of the bypass passages 64 and the central axis 16*a* of the tubular portion 16 of the catalyst 15, may be changed in a range from 25 degrees to 35 degrees. Through experiments and the like, the inventors discovered that, when the angle C was in the range from 25 degrees to 35 degrees, the temperature of the catalyst 15 was quickly increased by causing exhaust gas to strike the partition walls 17 of the catalyst 15.

Also, for example, if the catalyst 15 can be sufficiently heated by the exhaust gas that has flowed through the accommodation space 62 of the turbine housing 60, the acute angle C, which is defined by the central axes 64*b* of the outlet portions 64*a* of the bypass passages 64 and the central axis 16*a* of the tubular portion 16 of the catalyst 15, may be less than 25 degrees or greater than or equal to 35 degrees.

In the above-described embodiment, the configuration of the catalyst 15 can be changed. For example, when viewed in a direction along the central axis 16*a* of the tubular portion 16, the partition walls 17 of the catalyst 15 may have a honeycomb shape. In this case also, exhaust gas is caused to flow along the wall surfaces of the partition walls 17 by setting the acute angle C, which is defined by the central axes 64*b* of the outlet portions 64*a* of the bypass passages 64 and the central axis 16*a* of the tubular portion 16 of the catalyst 15, in a range from 25 degrees to 35 degrees.

<Modification to Manufacturing Method for Welding Turbine Wheel 90 and Connecting Shaft 80>

In the above-described embodiment, the manufacturing method for welding the turbine wheel 90 and the connecting shaft 80 to each other can be changed. For example, if the time required to weld the turbine wheel 90 and the connecting shaft 80 to each other is relatively short, and the manufacturing costs of the turbocharger 20 are unlikely to increase, the turbine wheel 90 and the connecting shaft 80 may be rotated two or more turns about the rotation axis 80*a* of the connecting shaft 80 when performing the welding.

<Other Modifications>

Japanese Laid-Open Patent Publication No. 2009-092026 discloses a turbocharger that includes a turbine wheel accommodated in a turbine housing. The turbine housing has a bypass passage defined therein. The bypass passage connects a section of the exhaust passage on the upstream side of the turbine wheel to a section of the exhaust passage on the downstream side of the turbine wheel. A wastegate, which selectively opens and closes the bypass passage, is attached to the turbine housing. The shaft of the wastegate is rotationally supported by walls of the turbine housing. The shaft has a support arm that extends from an end and outward in the radial direction of the shaft. A valve member is attached to the support arm to be swingable relative to the support arm.

In the turbocharger of Japanese Laid-Open Patent Publication No. 2009-092026, the valve member is allowed to swing relative to the support arm. Thus, chattering noise may occur at the part where the valve member is attached to the support arm, for example, when the wastegate switches the bypass passage from the open state to the closed state or when wastegate maintains the open state of the bypass passage. Such chattering noise may be perceived as unusual noise by occupants of the vehicle and is thus not favorable.

Taking these problems into consideration, the wastegate simply needs to be configured as an integral unit regardless whether a clearance is provided between the opposed surface of the flange of the turbine housing and the opposed surface of the flange of the bearing housing.

International Publication No. 2015/001644 discloses an internal combustion engine including an intake line to which the compressor housing of a turbocharger is attached. The compressor housing includes an accommodation space defined therein to accommodate a compressor wheel. The compressor housing includes an introduction passage defined therein to introduce intake air into the accommodation space. Guide vanes for regulating the flow of intake air protrude from the inner wall surface of the introduction passage. The guide vanes are spaced apart from each other in the circumferential direction of the introduction passage. The accommodation space of the compressor housing accommodates a compressor wheel. The compressor wheel includes a shaft portion, which extends in the rotation axis direction of the compressor wheel, and blades, which protrude radially outward from the shaft portion.

In the turbocharger of International Publication No. 2015/001644, intake air strikes the compressor wheel when the compressor wheel rotates and the intake air flows from the introduction passage to the accommodation space. The impact of the intake air striking the compressor wheel slightly vibrates the compressor wheel. Depending on the relationship between the number of the blades of the compressor wheel and the number of the guide vanes of the compressor housing, the vibration generated in the compressor wheel becomes too large to ignore.

Taking these problems into consideration, the number of the guide vanes of the compressor housing simply needs to be the smallest odd number greater than the number of the blades of the compressor housing regardless whether a clearance is provided between the opposed surface of the flange of the turbine housing and the opposed surface of the flange of the bearing housing.

Japanese Laid-Open Patent Publication No. 2015-127517 discloses a turbocharger that includes a substantially tubular bearing housing. The bearing housing incorporates a rotationally supported connecting shaft, which connects the turbine wheel and the compressor wheel to each other. A substantially disk-shaped seal plate is fixed to the intake side (the side corresponding to the compressor wheel) of the bearing housing. Specifically, the outer diameter of the seal plate is greater than the outer diameter of the bearing housing. The central portion of the seal plate is fixed to the bearing housing with screws. A compressor housing is fixed to the opposite side of the seal plate from the bearing housing. The seal plate and the compressor housing define a space, in which the compressor wheel is accommodated, and a scroll passage, through which intake air pressure-fed by the compressor wheel flows.

In the turbocharger of Japanese Laid-Open Patent Publication No. 2015-127517, the seal plate protrudes further radially outward than the outer circumferential surface of the bearing housing. Thus, when a force in the axial direction of the bearing housing acts on the radially outer portion of the seal plate, the seal plate may be deformed in a warping manner. If the seal plate is deformed, the sealing property between the seal plate and the compressor housing may be hindered, so that intake air may leak through the space between the seal plate and the compressor housing.

Taking these problems into consideration, the seal plate simply needs to contact the support portions of the bearing housing from the intake side regardless whether a clearance is provided between the opposed surface of the flange of the turbine housing and the opposed surface of the flange of the bearing housing.

Japanese National Phase Laid-Open Patent Publication No. 2004-512453 discloses a turbocharger that includes a bearing housing into which a cylindrical floating bearing is inserted. A connecting shaft that connects the turbine wheel and the compressor wheel to each other is inserted into the floating bearing. An end in the rotation axis direction of the connecting shaft protrudes out of the floating bearing.

A connecting shaft as disclosed in Japanese National Phase Laid-Open Patent Publication No. 2004-512453 is provided with a stopper portion at an end. The stopper portion has a larger outer diameter than the remaining portion. When the stopper portion of the connecting shaft contacts the end in the axial direction of the floating bearing, the connecting shaft is restricted from moving in the rotation axis direction relative to the floating bearing. Thus, the end in the axial direction of the floating bearing and the stopper portion of the connecting shaft are prone to being worn. Accordingly, there is a demand for a turbocharger structure that limits such wearing.

Taking these problems into consideration, the end face of a floating bearing that is opposed to the stopper portion of a connecting shaft simply needs to include land surfaces and tapered surfaces regardless whether a clearance is provided between the opposed surface of the flange of the turbine housing and the opposed surface of the flange of the bearing housing.

Japanese Laid-Open Patent Publication No. 2009-068380 discloses a configuration in which an end of the turbine wheel of a turbocharger is welded to an end of the connecting shaft. Specifically, according to the technique disclosed in Japanese Laid-Open Patent Publication No. 2009-068380, the end of the turbine wheel and the end of the connecting shaft are brought in to contact. Then, while causing an electron gun to project an electron beam to the contacting portions from an outside position in the radial direction of the connecting shaft, the turbine wheel and the connecting shaft are rotated about the rotation axis relative to the electron gun. The heat of the electron beam welds the ends of the connecting shaft and the turbine wheel to each other. Thereafter, while causing the electron gun to project an electron beam to the outer surface of the welded surface of the turbine wheel and the connecting shaft from an outside position in the radial direction of the connecting shaft, the turbine wheel and the connecting shaft are rotated about the rotation axis relative to the electron gun. This achieves a smooth welded portion of the turbine wheel and the connecting shaft.

According to the manufacturing method of Japanese Laid-Open Patent Publication No. 2009-068380, welding by the electron beam is performed twice. This extends the weld time for fixing the end of the connecting shaft and the end of the turbine wheel to each other. The extended weld time increases the manufacturing costs of the turbocharger.

Taking these problems into consideration, a manufacturing method simply needs to be employed in which the end of the turbine wheel and the end of the connecting shaft are welded by rotating the turbine wheel and the connecting shaft relative to the electron gun only one turn about the rotation axis of the connecting shaft regardless whether a clearance is provided between the opposed surface of the flange of the turbine housing and the opposed surface of the flange of the bearing housing.

Japanese Laid-Open Patent Publication No. 2017-078435 discloses a turbocharger that includes a turbine wheel accommodated in a turbine housing. A first end of the connecting shaft is fixed to the turbine wheel. The connecting shaft is accommodated in a support hole defined in the bearing housing. A substantially annular sealing member is attached to the outer circumferential surface of the end of the connecting shaft on the side corresponding to the turbine wheel. The sealing member fills the clearance between the outer circumferential surface of the end of the connecting shaft on the side corresponding to the turbine wheel and the inner circumferential surface of the support hole of the bearing housing.

In the turbocharger of Japanese Laid-Open Patent Publication No. 2017-078435, the pressure of the exhaust gas flowing through the turbine housing may become excessively high during operation of the internal combustion engine. Such an increase in the pressure of the exhaust gas can cause the exhaust gas flowing through the turbine housing to enter the bearing housing even though the clearance is filled with the sealing member.

Taking these problems into consideration, a configuration simply needs to be employed in which a second sealing member is disposed on the intake side of the first sealing member in the clearance between the outer circumferential surface of the end on the exhaust side of the connecting shaft and the inner circumferential surface of the support hole of the bearing housing regardless whether a clearance is provided between the opposed surface of the flange of the turbine housing and the opposed surface of the flange of the bearing housing.

Japanese Laid-Open Patent Publication No. 2018-087556 discloses an internal combustion engine that includes a catalyst that purifies exhaust gas and is installed in the middle of the exhaust line. The turbine housing of a turbocharger is attached to a section of the exhaust line on the upstream side of the catalyst. The turbine housing accommodates a turbine wheel, which is rotated by the flow of exhaust gas. The turbine housing has a bypass passage that connects a section of the exhaust passage on the upstream side of the turbine wheel to a section of the exhaust passage on the downstream side of the turbine wheel. The outlet portion of the bypass passage extends toward the catalyst, which is located on the downstream side of the turbine housing.

In the turbocharger according to Japanese Laid-Open Patent Publication No. 2018-087556, when exhaust gas flows through the bypass passage during operation of the internal combustion engine, the exhaust gas flows toward the catalyst, which is disposed on the downstream side of the turbine housing. The exhaust gas heats the catalyst to activate the catalyst, so that the catalyst exerts the purifying performance. Even if the flow rate and the temperature of the exhaust gas flowing toward the catalyst are the same, the rate at which the catalyst is heated varies depending on the angle defined by the partition walls of the catalyst and the flowing direction of the exhaust gas. The turbocharger according to Japanese Laid-Open Patent Publication No. 2018-087556 still has room for improvement since the publication gives no consideration to the flowing direction of exhaust gas from the bypass passage in association with the rate at which the catalyst is heated.

Taking these problems into consideration, a configuration simply needs to be employed in which, when viewed in a direction orthogonal to the central axis of the outlet portion of the bypass passage and orthogonal to the central axis of the tubular portion of the catalyst, the acute angle defined by the central axis of the outlet portion of the bypass passage and the central axis of the tubular portion of the catalyst is in a range from 25 degrees to 35 degrees regardless whether a clearance is provided between the opposed surface of the flange of the turbine housing and the opposed surface of the flange of the bearing housing.

Technical concepts obtained from the above embodiment and the modifications and advantages thereof will now be described.

A turbocharger comprising:

a turbine housing that accommodates a turbine wheel and has a bypass passage defined therein, the bypass passage connecting a section of an exhaust passage on an upstream side of the turbine wheel to a section of the exhaust passage on a downstream side of the turbine wheel, and a wastegate that is attached to the turbine housing and selectively opens and closes the bypass passage, wherein a valve seat for the wastegate is provided at an open edge of the bypass passage in an inner wall surface of the turbine housing, the wastegate includes a shaft that extends through a wall of the turbine housing and is rotationally supported by the wall, and a valve member that extends from an end of the shaft in the turbine housing in a radial direction of the shaft, a contact surface of the valve seat that is opposed to the valve member and a contact surface of the valve member that is opposed to the valve seat are both flat surfaces, and the wastegate is an integrally molded member that includes the shaft and the valve member.

In the above-described configuration, since the shaft and the valve member are integrally molded, the valve member does not swing relative to the shaft. This suppresses the generation of chattering noise due to swinging of the valve member.

In the above-described configuration, a rotation axis of the shaft is spaced apart from the valve seat toward a downstream side of the bypass passage in a direction orthogonal to the contact surface of the valve seat, and in a cross section that is orthogonal to the rotation axis of the shaft and includes the contact surface of the valve seat, a distance from the contact surface of the valve member to the rotation axis of the shaft in a direction orthogonal to the contact surface of the valve member is shorter than a distance from the contact surface of the valve seat to the rotation axis of the shaft in a direction orthogonal to the contact surface of the valve seat.

In a turbocharger, even if the valve seat of the turbine housing and the valve member of the wastegate are designed to make surface contact with each other in the fully closed state of the bypass passage, surface contact may fail to be achieved due to manufacturing errors or the like. Specifically, if the distance from the contact surface of the valve member to the rotation axis of the shaft in the direction orthogonal to the contact surface of the valve member is longer than the designed length, the valve member interferes with the valve seat before the wastegate is closed, so that the wastegate cannot rotate further toward the closing side. In the above-described configuration, the distance from the contact surface of the valve member to the rotation axis of the shaft in the direction orthogonal to the contact surface of the valve member is short. Thus, even if the turbine housing and the wastegate have some manufacturing errors, the valve member is unlikely to interfere with the valve seat before the wastegate is completely closed. Accordingly, the angle defined by the contact surface of the valve seat and the contact surface of the valve member in the closed state of the bypass passage is small as compared to a case in which the distance from the contact surface of the valve member to the rotation axis of the shaft in a direction orthogonal to the contact surface of the valve member is long. This reduces the clearance formed between the contact surface of the valve member and the contact surface of the valve seat in the fully closed state of the bypass passage.

The above-described configuration includes a link mechanism that is connected to an end of the shaft outside the turbine housing and transmits driving force from an actuator to the shaft, wherein the link mechanism includes a link arm that is connected to the end of the shaft outside the turbine housing, and a link rod that is connected to a section of the link arm that is spaced apart in the radial direction of the shaft from a connection center of the link arm and the shaft, the link rod is configured to move from a first side toward a second side in a longitudinal direction of the link rod when switching the bypass passage from a fully open state to a fully closed state, when the bypass passage is in the fully closed state, an imaginary straight line extending in the longitudinal direction of the link rod intersects with an imaginary plane that is parallel with the contact surface of the valve seat, and when the bypass passage is in the fully closed state, the contact surface of the valve member is inclined to shift toward the second side in the longitudinal direction of the link rod with respect to the rotation axis of the shaft as the distance from the link arm increases in the rotation axis direction of the shaft.

In the above-described configuration, when the bypass passage is maintained in the fully closed state, the link arm of the link mechanism applies to the shaft of the wastegate a force acting from the first side toward the second side in the longitudinal direction of the link rod. Then, the shaft of the wastegate is inclined such that the end outside the turbine housing is located on the second side in the longitudinal direction, and the end in the turbine housing is located on the first side in the longitudinal direction. In the above-described configuration, since the wastegate is an integrally molded member that includes the shaft and the valve member, the valve member, which is fixed to the shaft, is inclined when the shaft is inclined. In the above-described configuration, the contact surface of the valve member is inclined in expectation of the inclination of the valve member. This reduces the clearance that is formed between the valve member and the valve seat due to inclination of the shaft of the wastegate.

In the above-described configuration, the valve member includes a valve main body having the contact surface of the valve member, and a connection portion that connects the valve main body and the shaft to each other, and a dimension of the connection portion in a direction orthogonal to the contact surface of the valve member increases toward the shaft.

In the above-described configuration, the closer to the shaft in the valve member, the greater the stress generated by the valve member pressing the valve seat becomes. Since the valve member of the above-described configuration is thicker in a section where the stress is greater, the occurrence of deformation and cracking in the valve member is suppressed.

A turbocharger comprising:

a compressor housing attached to an intake line; and a compressor wheel that is accommodated in the compressor housing, wherein the compressor wheel includes a shaft portion that extends in a rotation axis direction of the compressor wheel, and a plurality of blades that protrudes outward from the shaft portion in a radial direction, the blades are spaced apart from each other in a circumferential direction of the compressor wheel, an accommodation space and an introduction passage are defined in the compressor housing, the accommodation space is configured to accommodate the compressor wheel, the introduction passage is connected to the accommodation space from a first side in the rotation axis direction to introduce intake air into the accommodation space, a plurality of plate-shaped guide vanes protrude from an inner wall surface of the introduction passage, the guide vanes are spaced apart from each other in a circumferential direction of the introduction passage, and a number of the guide vanes is the smallest odd number that is greater than a number of the blades.

In the above-described configuration, intake air does not flow in a section where the guide vanes are provided, but flows in a section where the guide vanes are not provided. This generates intake air streams the number of which corresponds to the number of the guide vanes. These intake air streams strike ends of the blades of the compressor wheel, which generates vibration in the compressor wheel. If the number of the intake air streams (the number of the guide vanes) is the same as the number of the blades of the compressor wheel, the intake air streams strike the respective blades substantially simultaneously. Thus, the vibrations of the blades will not cancel each other. This may increase the vibration of the compressor wheel as a whole. In this respect, in the above-described configuration, the number of the guide vanes is neither the same as the number of the blades of the compressor wheel nor a multiple of the number of the blades. Accordingly, the regulated intake air streams strike the ends of the blades and generate vibration at different times, so that the vibrations are likely to interfere with each other and be attenuated. Further, in the above-described configuration, the number of intake air streams, which corresponds to the number of the guide vanes, is greater than that in a case in which the number of the guide vanes is smaller than the number of the blades. This reduces the vibration generated in the blade by a single intake air stream. Also, the number of the guide vanes is the smallest odd number that is greater than the number of the blades. This minimizes an increase in the intake resistance due to the guide vanes.

In the above-described configuration, the compressor wheel includes a plurality of auxiliary blades that protrudes outward from the shaft portion in the radial direction, the auxiliary blades are each arranged between two of the blades that are arranged side by side in a circumferential direction of the compressor wheel, and the ends of the blades on the first side in the rotation axis direction are located on the first side in the rotation axis direction of the ends of the auxiliary blades on the first side in the rotation axis direction.

In the above-described configuration, the ends on the upstream side of the blades are located on the upstream side of the ends on the upstream side of the auxiliary blades. Thus, most of the streams that have flowed toward the downstream side of the guide vanes strike the ends on the upstream side of the blades. In the above-described configuration, since the number of the guide vanes is set with reference to the number of the blades located on the upstream side, the vibration of the compressor wheel is effectively reduced.

In the above-described configuration, a central axis of the introduction passage coincides with the rotation axis, a first side in the rotation axis direction of the introduction passage is open to the outside of the compressor housing, in the rotation axis direction, a point at which a distance from an end on the first side of the introduction passage is equal to a distance from an end on the first side of the blade is defined as a midpoint, and in the rotation axis direction, the guide vanes extend from the ends on the first side in the introduction passage to points between the midpoint and the blades.

With the above-described configuration, the guide vanes extend beyond the half of the introduction passage, which extends from the opening of the introduction passage to the blades of the compressor wheel. The guide vanes thus have an improved flow regulating performance. Also, since the distance between the ends of the guide vanes and the ends of the blades is relatively small, the regulated flow of intake air readily reaches the blades without being diffused.

In the above-described configuration, the compressor housing includes a housing body that includes the accommodation space defined therein and an insertion hole defined therein, the insertion hole extending toward the first side in the rotation axis direction from the accommodation space and opening to the outside of the compressor housing, and a tubular member that is inserted into the insertion hole, the insertion hole includes a small diameter portion, and a large diameter portion that has an inner diameter greater than that of the small diameter portion, the large diameter portion being located on the first side in the rotation axis direction of the small diameter portion and extending from the small diameter portion to an end on the first side in the rotation axis direction of the insertion hole, the tubular member is fitted into the large diameter portion, and an interior of the tubular member constituting the introduction passage, and the tubular member and the guide vanes are parts of an integrally molded member.

The above-described configuration provides the guide vanes in the compressor housing simply by fitting the tubular member into the opening of the insertion hole of the housing body. Since the guide vanes are not provided in the housing body, the shape of the housing body is prevented from being complicated due to the guide vanes.

A turbocharger comprising:

a bearing housing into which a connecting shaft that connects a turbine wheel and a compressor wheel to each other is inserted;

a seal plate that is fixed to a first side in a rotation axis direction of the connecting shaft of the bearing housing; and a compressor housing that is fixed to a first side in the rotation axis direction of the seal plate, the compressor housing defining, together with the seal plate, an accommodation space for the compressor wheel, wherein the bearing housing includes a main body that rotationally supports the connecting shaft, and a support portion that protrudes from an outer circumferential surface of the main body and outward in a radial direction of the connecting shaft, and the seal plate contacts the support portion from the first side in the rotation axis direction.

With the above-described configuration, even if the radially outer portion of the seal plate that is located radially outward of the main body of the bearing housing is deformed from the first side toward the second side in the rotation axis direction of the connecting shaft, the deformation is restricted by the support portion of the bearing housing. This limits deformation of the seal plate even if a force from the first side toward the second side in the rotation axis direction of the connecting shaft is applied to the radially outer portion of the seal plate.

In the above-described configuration, the seal plate is fixed to the support portion.

Thus, even if the radially outer portion of the seal plate is deformed from the second side toward the first side in the rotation axis direction of the connecting shaft, the deformation is restricted by the support portion of the bearing housing. This limits deformation of the seal plate to either side in the rotation axis direction of the connecting shaft even if a force in the rotation axis direction of the connecting shaft acts on the radially outer portion of the seal plate.

In the above-described configuration, the support portion is one of a plurality of support portions, and the support portions are spaced apart from each other in the circumferential direction of the connecting shaft.

While limiting deformation of the seal plate, the above-described configuration minimizes an increase in weight of the bearing housing due to the existence of the support portions as compared to a configuration in which a support portion extends over the entire area in the circumferential direction.

In the above-described configuration, one of the support portions, which are spaced apart from each other in the circumferential direction of the connecting shaft, is defined as a first support portion, one of the support portions, which are spaced apart from each other in the circumferential direction of the connecting shaft, is defined as a second support portion that is different from the first support portion, a straight line that is orthogonal to the rotation axis and extends through the first support portion is defined as an imaginary straight line, the first support portion is located on the first side in the direction along the imaginary straight line with respect to the rotation axis, and the second support portion is located on the second side in the direction along the imaginary straight line with respect to the rotation axis of the connecting shaft.

In the above-described configuration, the radially outer portion of the seal plate contacts the first support portion and the second support portion, which are located on the opposite sides of the connecting shaft. This limits deformation of the radially outer portion of the seal plate in the circumferential direction of the connecting shaft.

A turbocharger, wherein a turbine housing that accommodates a turbine wheel and a compressor housing that accommodates a compressor wheel are connected to each other via a bearing housing, a tubular floating bearing is inserted into the hearing housing, a connecting shaft that connects the turbine wheel and the compressor wheel to each other is inserted into the floating bearing, oil is supplied to a space between an inner circumferential surface of the floating bearing and an outer circumferential surface of the connecting shaft, the connecting shaft includes a rod-shaped shaft body that is inserted into the floating bearing, and a stopper portion that protrudes outward from the outer circumferential surface of the shaft body in a radial direction, the stopper portion extending over an entire area in the circumferential direction of the connecting shaft, a part of the shaft body protrudes out of the floating bearing from an end face in an axial direction of the floating bearing, the stopper portion protrudes from the outer circumferential surface of the part of the shaft body, the end face of the floating bearing includes a land surface opposed to the stopper portion, and a tapered surface that is adjacent to the land surface in the circumferential direction of the shaft and is inclined relative to the land surface, the tapered surface is recessed with respect to the land surface, and the tapered surface is inclined to approach the stopper portion in a rotation axis direction of the connecting shaft toward a leading side in a rotation direction of the connecting shaft during operation of the turbocharger.

In the above-described configuration, the oil between the end face of the floating bearing and the stopper portion of the connecting shaft is dragged by the rotation of the stopper portion of the connecting shaft and flows in the rotation direction of the connecting shaft. In the above-described configuration, the tapered surface of the floating bearing is inclined to approach the stopper portion toward the leading side in the rotation direction of the connecting shaft. That is, the distance between the tapered surface and the stopper portion decreases toward the leading side in the rotation direction of the connecting shaft. Since oil attempts to flow into this narrow section, the pressure in the narrow section is increased. The pressure of the oil between the tapered surface and the stopper portion is thus increased, so that a sufficient clearance between the end face of the floating bearing and the stopper portion of the connecting shaft is ensured. This prevents these parts from being worn due to contact.

In the above-described configuration, the end face of the floating bearing includes a plurality of land surfaces that are spaced apart from each other in the circumferential direction of the connecting shaft, and a plurality of tapered surfaces each located between the land surfaces, which are spaced apart from each other in the circumferential direction of the connecting shaft.

In the above-described configuration, the pressure of the oil between each tapered surface and the stopper portion is increased by the flow of the oil between the end face of the floating bearing and the stopper portion of the connecting shaft. Sections of higher pressures of oil are thus dispersed in the circumferential direction of the connecting shaft. This limits inclination of the connecting shaft relative to the floating bearing caused by the pressure of oil acting on the stopper portion of the connecting shaft.

In the above-described configuration, the end face of the floating bearing has a groove that is recessed from each tapered surface. The grooves extend outward in the radial direction of the connecting shaft from the inner periphery of the end face of the floating bearing.

The above-described configuration allows the oil between the inner circumferential surface of the floating bearing and the outer circumferential surface of the shaft portion of connecting shaft to be supplied to the tapered surfaces via the grooves. This supplies a sufficient amount oil to the space between the tapered surfaces and the stopper portion.

In the above-described configuration, the grooves do not reach the outer periphery of the floating bearing.

In the above-described configuration, the oil that has flowed into the grooves from the inner peripheral edge of the floating bearing is unlikely to flow radially outward of the outer periphery of the floating bearing. This limits reduction in the amount oil supplied to the tapered surfaces via the grooves. The oil thus improves the lubricity between the end face of the floating bearing and the stopper portion of the connecting shaft.

In the above-described configuration, each groove is located at the end of the tapered surface on the side opposite to the leading side in the rotation direction of the connecting shaft during operation of the turbocharger.

In the above-described configuration, each groove is located in a section where the distance between the tapered surface and the stopper portion is the greatest in the rotation axis direction of the connecting shaft. That is, the groove is located in a section where the pressure of the oil between the tapered surface and the stopper portion is relatively low. Thus, the oil that has flowed into the groove is readily supplied to the space between the tapered surface of the floating bearing and the stopper portion of the connecting shaft.

In the above-described configuration, the bearing housing includes an oil discharge space and an oil discharge port defined therein, the oil discharge space is configured to discharge, to the outside, oil supplied to the space between the floating bearing and the connecting shaft, the discharge port connects the oil discharge space to the outside of the bearing housing, and at least a part of the oil discharge space is defined to encompass the end of the floating bearing on the side corresponding to the stopper portion and is connected to the space between the end face of the floating bearing and the stopper portion.

In the above-described configuration, the oil supplied to the space between the end face of the floating bearing and the stopper portion of the connecting shaft reaches the discharge space after flowing outward in the radial direction of the connecting shaft. Thus, the oil is discharged to the outside of the bearing housing via the oil discharge port. This prevents oil from being stagnant between the end face of the floating bearing and the stopper portion of the connecting shaft. As a result, the flow of oil between the end face of the floating bearing and the stopper portion of the connecting shaft is not hindered by stagnant oil.

A method for manufacturing a turbocharger, wherein the turbocharger includes a turbine wheel that is accommodated in a turbine housing, a compressor wheel that is accommodated in a compressor housing, and a connecting shaft that connects the turbine wheel and the compressor wheel to each other, and in the method for manufacturing a turbocharger, an end of the turbine wheel and an end of the connecting shaft are welded by rotating the turbine wheel and the connecting shaft only one turn about a rotation axis of the connecting shaft while causing an electron gun to project an electron beam to a contacting portions of the end of the turbine wheel and the end of the connecting shaft from an radially outer side with respect to the connecting shaft.

In the above-described configuration, the welding is performed by rotating only one turn the turbine wheel and the connecting shaft about the rotation axis of the connecting shaft. This reduces the weld time as compared to a manufacturing method that rotates multiple turns the turbine wheel and the connecting shaft about the rotation axis of the turbine wheel.

A turbocharger comprising:

a turbine housing that accommodates a turbine wheel;

a compressor housing that accommodates a compressor wheel;

a bearing housing that connects the compressor housing and the turbine housing to each other; and a connecting shaft that connects the turbine wheel and the compressor wheel to each other and is accommodated in the bearing housing, wherein the bearing housing includes a support hole in which the connecting shaft is accommodated, the support hole extending through the bearing housing from a side corresponding to the turbine housing to a side corresponding to the compressor housing, a first sealing member that extends in a circumferential direction of the connecting shaft is disposed between an outer circumferential surface of an end of the connecting shaft on a side corresponding to the turbine wheel and an inner circumferential surface of the support hole, and a second sealing member that extends in the circumferential direction of the connecting shaft is disposed between the outer circumferential surface of the end of the connecting shaft on the side corresponding to the turbine wheel and the inner circumferential surface of the support hole, the second sealing member being closer to the compressor wheel than the first sealing member.

In the above-described configuration, when the pressure of the exhaust gas flowing through the turbine housing increases, the exhaust gas may flow into a section of the space between the outer circumferential surface of the connecting shaft and the inner circumferential surface of the support hole, the section being closer to the compressor wheel than the first sealing member. In the above-described configuration, even if exhaust gas flows into a section closer to the compressor wheel than the first sealing member, the second sealing member, which is disposed between the outer circumferential surface of the connecting shaft and the inner circumferential surface of the support hole, limits entry of exhaust gas into the space closer to the compressor wheel than the second sealing member.

In the above-described configuration, a range of extension of the first sealing member in the circumferential direction of the connecting shaft greater than or equal to 180 degrees and less than 360 degrees, a range of extension of the second sealing member in the circumferential direction of the connecting shaft greater than or equal to 180 degrees and less than 360 degrees, and when viewed in the rotation axis direction of the connecting shaft, at least one of the first sealing member and the second sealing member exists at any position in the entire area in the circumferential direction of the connecting shaft.

In the above-described configuration, exhaust gas may flow into a section closer to the compressor wheel than the first sealing member through a clearance between the outer circumferential surface of the connecting shaft and the inner circumferential surface of the support hole where the first sealing member does not exist. In the above-described configuration, the first sealing member and the second sealing member are located on the opposite sides of the connecting shaft. Thus, even if exhaust gas flows in through the clearance in the first sealing member, the second sealing member limits entry of the exhaust gas.

In the above-described configuration, the bearing housing includes a coolant passage defined therein, coolant flowing through the coolant passage, and a part of the coolant passage extends to a position that is closer to the turbine wheel than the second second sealing member in the rotation axis direction of the connecting shaft.

In the above-described configuration, a part of the coolant passage extends beyond the second sealing member and toward the first sealing member in the rotation axis direction of the connecting shaft. Thus, the heat exchange with the coolant flowing through the coolant passage cools the first sealing member as well as the second sealing member. Accordingly, the temperatures of the first sealing member and the second sealing member are prevented from being excessively high due to the heat of the exhaust gas flowing through the turbine housing. This limits degradation of the first sealing member and the second sealing member due to excessively increased temperatures.

An exhaust structure for an internal combustion engine, comprising:

an exhaust line through which exhaust gas flows;

a turbine housing of a turbocharger attached to the exhaust line; and a catalyst configured to purify exhaust gas, the catalyst being attached to a section of the exhaust line that is on a downstream side of the turbine housing, wherein the catalyst includes a tubular portion, and a plurality of partition walls that extend in a direction of a central axis of the tubular portion, the turbine housing includes an accommodation space, a bypass passage, a discharge passage, and a bypass passage defined therein, the accommodation space accommodates a turbine wheel, the scroll passage is connected to the accommodation space and draws in exhaust gas from the outside of the turbine housing to the accommodation space, the exhaust passage is connected to the accommodation space and discharges exhaust gas from the accommodation space to the outside of the turbine housing, the bypass passage is connected to the scroll passage and the exhaust passage and bypasses the turbine wheel, an upstream end of the catalyst is located on a central axis of an outlet portion of the bypass passage, the central axis of the outlet portion intersects with the partition walls, and when viewed in a direction orthogonal to the central axis of the outlet portion and orthogonal to the central axis of the tubular portion, an acute angle defined by the central axis of the outlet portion and the central axis of the tubular portion is in a range from 25 degrees to 35 degrees.

If the central axis of the outlet portion of the bypass passage and the central axis of the tubular portion of the catalyst are parallel with each other, the exhaust gas that has flowed through the bypass passage may flows toward the downstream side without striking the wall surfaces of the partition walls of the catalyst. Also, if the angle defined by the central axis of the outlet portion of the bypass passage and the central axis of the tubular portion of the catalyst approaches 90 degrees, the exhaust gas that has flowed through the bypass passage strikes the upstream end of the catalyst, so that the exhaust gas stagnates in the portion that is on the upstream side of the catalyst in some cases.

In the above-described configuration, when the exhaust gas that has flowed through the bypass passage reaches the catalyst on the downstream side, the exhaust gas strikes the wall surfaces of the partition walls of the catalyst. The exhaust gas that has stricken the wall surfaces of the partition walls of the catalyst flows toward the downstream side along the wall surfaces of the first partition walls. Accordingly, the heat of the exhaust gas is transferred to the partition walls, so that the temperature of the catalyst is quickly increased. The above-described configuration prevents the exhaust gas that has flowed through the bypass passage from striking the upstream end of the catalyst. Thus, the exhaust gas does not stagnate in the section of the exhaust line that is on the upstream side of the catalyst.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A turbocharger comprising:

a turbine housing that accommodates a turbine wheel; and a bearing housing that rotationally supports a connecting shaft connected to the turbine wheel, wherein a flange extends outward in a radial direction of the connecting shaft from an end of the turbine housing on a first side in a rotation axis direction of the connecting shaft, a flange extends outward in the radial direction of the connecting shaft from an end of the bearing housing on a second side in the rotation axis direction of the connecting shaft, the flange of the turbine housing and the flange of the bearing housing are fastened and fixed to each other by a fixing member in the rotation axis direction of the connecting shaft, an annular heat shield plate is disposed between the turbine housing and the bearing housing, the heat shield plate is clamped by the turbine housing and the bearing housing, the flange of the turbine housing includes an opposed surface that is opposed to the flange of the bearing housing in the rotation axis direction of the connecting shaft, the flange of the bearing housing includes an opposed surface that is opposed to the flange of the turbine housing in the rotation axis direction of the connecting shaft, and a clearance is disposed in an entire area between the opposed surface of the turbine housing and the opposed surface of the bearing housing.

2. The turbocharger according to claim 1, wherein the heat shield plate has an outer peripheral portion that is an outer portion in a radial direction and has a shape of a flat plate, and the outer peripheral portion is clamped by the turbine housing and the bearing housing in a thickness direction of the outer peripheral portion.

3. The turbocharger according to claim 1, wherein the heat shield plate has an outer peripheral portion that is an outer portion in a radial direction, and the outer peripheral portion is clamped by the turbine housing and the bearing housing in an entire area in a circumferential direction of the connecting shaft.

* * * * *